US009279277B2

(12) United States Patent
Spurr et al.

(10) Patent No.: US 9,279,277 B2
(45) Date of Patent: Mar. 8, 2016

(54) LATCH ASSEMBLY

(75) Inventors: Nigel Victor Spurr, Solihull (GB); Peter Coleman, Worcestershire (GB); Dominique Attanasio, Staffordshire (GB); Robert Tolley, Staffordshire (GB)

(73) Assignee: INTEVA PRODUCTS USA, LLC, Troy, MI (US)

( * ) Notice: Subject to any disclaimer, the term of this patent is extended or adjusted under 35 U.S.C. 154(b) by 1472 days.

(21) Appl. No.: 12/528,171

(22) PCT Filed: Jan. 31, 2008

(86) PCT No.: PCT/GB2008/000328

§ 371 (c)(1),
(2), (4) Date: Apr. 7, 2011

(87) PCT Pub. No.: WO2008/102097

PCT Pub. Date: Aug. 28, 2008

(65) Prior Publication Data

US 2011/0260475 A1 Oct. 27, 2011

(30) Foreign Application Priority Data

Feb. 23, 2007 (GB) ..... 0703597.5

(51) Int. Cl.

| | |
|---|---|
| ***E05C 3/06*** | (2006.01) |
| ***E05B 85/26*** | (2014.01) |
| ***E05B 81/14*** | (2014.01) |
| *E05B 17/00* | (2006.01) |
| *E05B 77/02* | (2014.01) |

(52) U.S. Cl.

CPC ..... *E05B 85/26* (2013.01); *E05B 81/14* (2013.01); *E05B 17/007* (2013.01); *E05B 77/02* (2013.01)

(58) Field of Classification Search

USPC ..... 292/195, 197, 216

See application file for complete search history.

(56) References Cited

U.S. PATENT DOCUMENTS

| | | | | |
|---|---|---|---|---|
| 4,988,135 | A * | 1/1991 | Ottino | 292/201 |
| 6,003,910 | A * | 12/1999 | Dupont et al. | 292/201 |
| 8,235,428 | B2 * | 8/2012 | Hunt et al. | 292/216 |

(Continued)

FOREIGN PATENT DOCUMENTS

| | | |
|---|---|---|
| DE | 19631262 | 2/1998 |
| DE | 202004020037 | 3/2006 |

(Continued)

OTHER PUBLICATIONS

JP2008530407 English Abstract.

(Continued)

*Primary Examiner* — Mark Williams
(74) *Attorney, Agent, or Firm* — Cantor Colburn LLP

(57) ABSTRACT

A latch assembly includes a chassis, a latch bolt movably mounted on the chassis and having a closed position for retaining a striker and an open position for releasing the striker, and a pawl having an engaged position at which the pawl is engaged with the latch bolt to hold the latch bolt in the closed position and a disengaged position at which the pawl is disengaged from the latch bolt thereby allowing the latch bolt to move to the open position. The pawl is rotatably mounted via a pawl pivot pin about a pawl axis, and the pawl pivot pin includes a first arcuate portion having a first radius about the pawl axis. A cross-sectional area of the pawl pivot pin, taken perpendicular to the pawl axis, is greater than an area of a circle having the first radius.

10 Claims, 20 Drawing Sheets

(56) References Cited

U.S. PATENT DOCUMENTS

| | | | | |
|---|---|---|---|---|
| 2003/0070457 | A1 | 4/2003 | Arlt et al. | |
| 2008/0217928 | A1* | 9/2008 | Spurr | 292/198 |
| 2008/0303291 | A1* | 12/2008 | Spurr | 292/216 |

FOREIGN PATENT DOCUMENTS

| | | |
|---|---|---|
| EP | 0978609 | 2/2000 |
| EP | 1154106 | 11/2001 |
| GB | 2339593 | 2/2000 |
| GB | 2409706 | 7/2005 |
| JP | 63-146066 | 9/1998 |
| JP | 2008-530407 A | 8/2008 |
| WO | 2006/087578 | 8/2006 |
| WO | 2008/102097 A1 | 8/2008 |

OTHER PUBLICATIONS

International Search Report dated May 15, 2008.
Written Opinion of PCT/GB2008/000328.

* cited by examiner

LATCH ASSEMBLY

REFERENCE TO RELATED APPLICATIONS

This application is a United States National Phase Application of PCT Application No. PCT/GB2008/000328 filed Jan. 31, 2008, which claims priority to United Kingdom Application No. GB 0703597.5 filed Feb. 23, 2007.

BACKGROUND OF THE INVENTION

The present invention relates to latch assemblies, and in particular latch assemblies for use with car doors and car boots.

Latch assemblies are known to releasably secure car doors in a closed position. Operation of an inside door handle or an outside door handle would release the latch, allowing the door to open. Subsequent closure of the door will automatically relatch the latch. Electric actuators are commonly employed in car latches in order to release them. Known latches incorporate a rotatable claw which engages with a striker mounted on an opposing surface (for example, a car door frame) in order to retain the door in a closed position. This rotating claw is often held in position by a pawl, which is also often a rotating component. Release of the claw is thereby achieved by rotating the pawl from an engaged position, whereby it engages and retains the claw, to a disengaged position, whereby the claw is free to rotate. Movement of the pawl is often undertaken by electric actuators. It is desirable to reduce the amount of force required to move the pawl from an engaged position to a disengaged position such that the size of the electric actuator can be reduced, thereby reducing weight and part cost.

Simple known latch assemblies include a pawl that is mounted to rotate about a single axis. Such pawls are rotatably mounted on a substantially cylindrical pawl pivot pin inserted into a circular pawl pin orifice in the pawl. The pawl pivot pin is fixed to a stationary latch chassis. The pawl pivot pin has to be of a certain radius in order to withstand loads that the latch may undergo during normal operation and also during high load impact events.

A problem with this type of known latch is that a radius of the pawl pivot pin, which as described must be of a certain magnitude to withstand loads, is directly related to the size of the contact area between the pawl and said pawl pivot pin. This is problematic as the amount of friction between these two components is influenced by the amount of dust and contaminants that may accrue between them. Therefore, as the contact surface area is increased, the levels of friction inherent within the latch in use is also increased, and a greater actuation force is required to overcome such friction. Therefore, larger and more expensive actuators are required which is undesirable.

GB2409706 shows an example of a low energy release latch 100 (as shown in FIG. 1) including a first pawl 140 pivotally attached to a toggle link 130, and also to a second pawl 160 configured to retain the toggle link 130. A high level of force acts on the first pawl 140 as a result of the vehicle door seal load, driving the claw 120 in a clockwise direction. The seal load acts to collapse the toggle link and pawl arrangement as shown in FIG. 8, which is prevented in FIG. 1 by the interaction of the first pawl 140 and the second pawl 160. Release of the low energy release latch 100 is therefore achieved by a clockwise rotation of the second pawl 160, which in turn releases the first pawl 140.

WO/2006/087578 discloses a device (see FIG. 1), in which the first pawl 16 is mounted on a crankshaft 50. Door seal loads act to rotate the rotating claw 14 in a clockwise direction, which rotation is prevented by the first pawl 16. The first pawl 16 is mounted on a crankshaft 18 and is configured such that force FP acts to generate a clockwise torque on the crankshaft 18, which is rotatationally constrained by a release plate 72 acting on a release lever 52 (see FIG. 1B). Release by actuation of the release plate 72 allows the crankshaft 50 to rotate and the pawl to move under force FP to enable the latch to open.

It can be clearly seen in WO/2006/087578 that the radius on which the first pawl 16 rotates about a crank pin 54 is necessarily large in order to encompass a cylindrical pin 56 (see FIG. 1C). The radius of the crank pin 54 therefore has to be equal to at least the distance between the crank pin axis Y and the crank shaft axis A plus the radius of the cylindrical pin 56 (i.e., the minimum required radius $r_{min}$).

Such a large radius of rotation means that a perimeter of a pivot hole 46 is significant. Typically, the radius of the pivot hole 46 is in the order of 9 millimeters or more. This is problematic as dust contamination can cause excessive friction between the first pawl 16 and the crankshaft 50, increasing the effort required to rotate them relative to each other. This is undesirable as larger actuators are required to rotate the two components relative to each other.

Any attempt to reduce the radius of the crankshaft 50 to distances below the minimum required radius $r_{min}$ would result in significant weakening of the crankshaft and consequently likely failure of this component.

Referring to FIG. 1 of WO/2006/087578, a torque is applied to an eccentric 54 as the line of action of force FP is offset from an axis A. The size of the lever arm at which this torque is applied is determined by the start angle of the eccentric 54 (i.e., in the closed position). By way of explaining what is meant by "start angle", at start angles of 0 and 180 degrees, the eccentric 54 is at top dead center (unstable equilibrium) and bottom dead center (stable equilibrium), respectively. As the angle tends towards 90 degrees, the lever arm increases to a maximum, and the maximum torque for a given force FP is applied to the eccentric.

As the start angle decreases, the lever arm producing the torque on the eccentric 54 decreases. As such, if the angle is too low (i.e., below a minimum backdrive angle), the torque produced by the lever arm and the force FP will be insufficient to overcome the friction in the system, rotate the eccentric 54, and open the latch. In known latch arrangements, the start angle must be above the minimum backdrive angle, typically in the order of 54 degrees.

This minimum backdrive angle is indicative of the friction inherent in the latch assembly and therefore of the torque required to open the latch assembly. If it is reduced, a lower torque is sufficient to open the latch. This is beneficial as less effort is therefore required to release and latch the latch.

SUMMARY OF THE INVENTION

It is an object of the present invention to provide a lower energy release latch by overcoming the above disadvantages.

According to a first aspect of the present invention, there is provided a latch assembly having a chassis, a latch bolt movably mounted on the chassis and having a closed position for retaining a striker and an open position for releasing the striker, and a pawl having an engaged position at which the pawl is engaged with the latch bolt to hold the latch bolt in the closed position and a disengaged position at which the pawl is disengaged from the latch bolt, thereby allowing the latch bolt to move to the open position. The pawl is rotatably mounted via a pawl pivot pin about a pawl axis, and the pawl pivot pin includes a first arcuate portion having a first radius about the pawl axis. A cross-sectional area of the pawl pivot pin, taken perpendicular to the pawl axis, is greater than an area of a circle having the first radius.

By having a pawl pivot pin cross sectional area substantially greater than the area of the circle having the radius of the first arcuate portion, it is possible to have a first arcuate portion of relatively small radius without compromising the strength of the pawl pivot pin. This lower radius of the first arcuate portion means that the detrimental effect of dust and contaminants is reduced, as the mating area between the pawl pivot pin and the surface against which it rotates is reduced. This also reduces the minimum backdrive angle compared to known latches.

In one example, the pawl pivot pin is mounted in a pawl pin orifice including a second arcuate portion having a second radius about the pawl axis, substantially similar to the first radius, and in which a cross-sectional area of the pawl pin orifice, taken perpendicular to the pawl axis, is greater than a area of a circle having the second radius.

The arrangement may use a "live" pivot (i.e., in which the pawl pivot pin is connected to the pawl and the pawl pin orifice is defined in an adjacent component, e.g., the chassis or an eccentric) or a "dead" pivot (in which the pawl pivot pin is connected to the chassis or the eccentric and the pawl pin orifice is defined in the pawl).

According to a second aspect of the present invention, there is provided a latch assembly having a chassis, a latch bolt movably mounted on the chassis and having a closed position for retaining a striker and an open position for releasing the striker, and a pawl having an engaged position at which the pawl is engaged with the latch bolt to hold the latch bolt in the closed position and a disengaged position at which the pawl is disengaged from the latch bolt, thereby allowing the latch bolt to move to the open position. The pawl is rotatably mounted via a pawl pivot pin about a pawl axis, and the pawl pivot pin is rotatably mounted in a pawl pin orifice including a pawl pin orifice arcuate portion having a second radius about the pawl axis. A cross-sectional area of the pawl pin orifice, taken perpendicular to the pawl axis, is greater than an area of a circle having the second radius.

By making the cross sectional area of the pawl pin orifice greater than that of a circle having the radius of the second arcuate portion, it is ensured that less than an entire perimeter of the pawl pivot pin is in contact with the pawl pin orifice. Therefore, the contact area between the pawl pivot pin and the pawl pin orifice is reduced compared to known arrangements, and as such, the effect of dust and contaminants is reduced. Furthermore, the fact that the area of the pawl pin orifice is significantly larger than the area of the pawl pivot pin leaves a gap from which dust and contaminants can escape and be ejected from the mechanism. In this manner, the amount of friction in the latch is reduced, and consequently, the size of the actuators may also be reduced. Furthermore, the likelihood of the latch becoming stuck or jammed because of friction arising from dust or contaminants is also reduced.

BRIEF DESCRIPTION OF THE DRAWINGS

The invention will now be described by way of example only, with reference to the accompanying drawings, in which.

DETAILED DESCRIPTION OF THE PREFERRED EMBODIMENT

Figure 1:
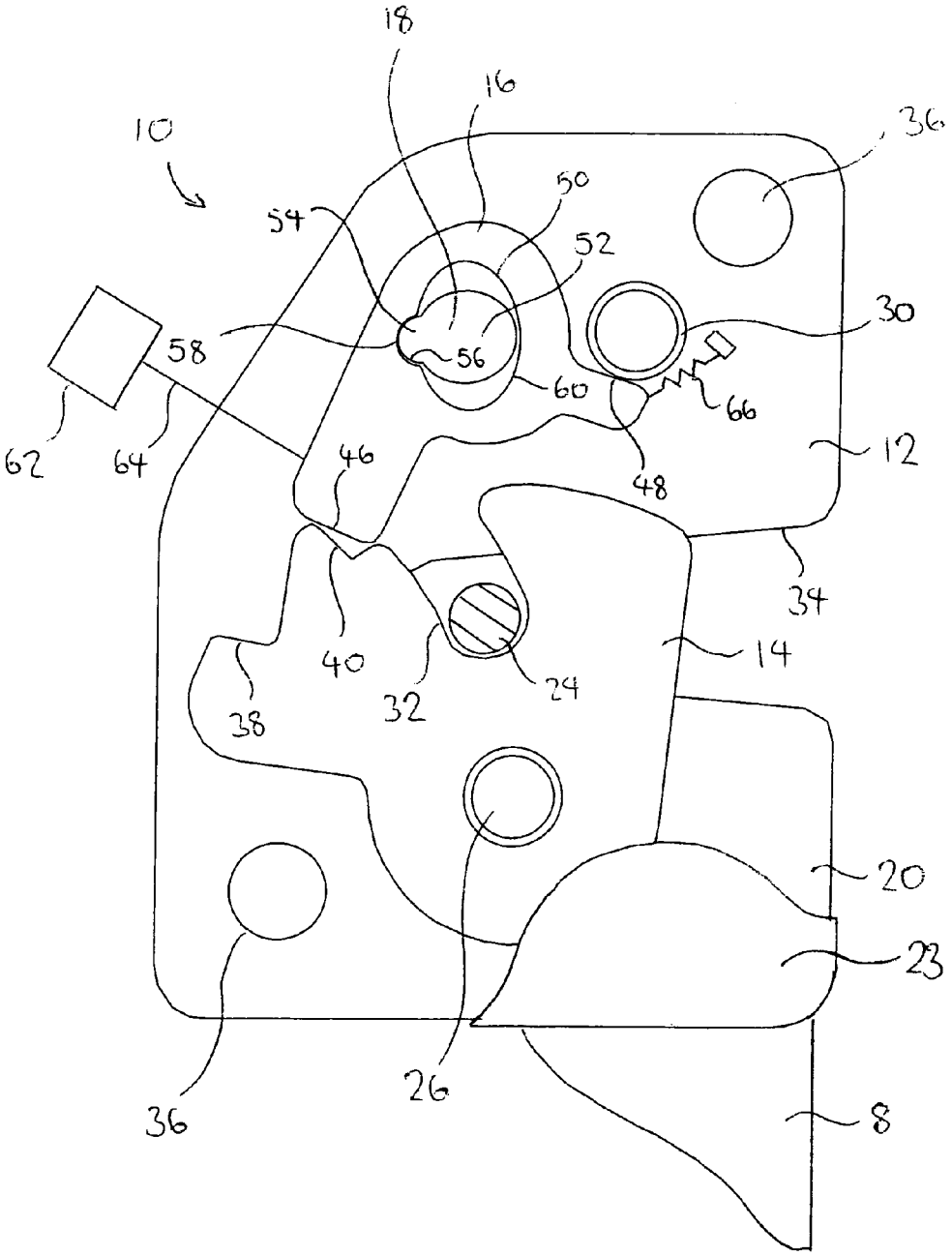
FIG. 1 is a backplate side view of certain components of a first embodiment of a latch assembly according to the present invention in a closed position.

With reference to FIG. 1, there is shown a latch assembly 10 including a latch chassis 12, a latch bolt in the form of a rotating claw 14, a pawl 16, and a pawl pivot pin 18. The latch assembly 10 is mounted on a door 8 (only shown in FIG. 1).

The major components of the latch chassis 12 are a retention plate 20 and a backplate 23 (only shown partially in FIG.

1). The backplate 23 is mounted on an opposite side of the latch assembly 10 such that views from a backplate side are in an opposite direction to views from a retention plate side of the latch assembly 10. The retention plate 20 is generally planar and includes a mouth 22 for receiving a striker 24, generally attached to a door frame (not shown). Projecting from the retention plate 20 is a claw pivot pin 26, a pawl pivot pin 28 and a stop pin 30. The pawl pivot pin 18 includes a cylindrical body 52 and a lug 54 generally offset from the cylindrical body 52 and including a first arcuate portion 56 of a radius A. In this case, the pawl pivot pin 18 is non-rotatably fixed to the latch chassis 12.

The retention plate 20 further includes a mouth 34 for receiving the striker 24. Furthermore, the retention plate 20 further includes threaded holes 36 which in use are used to secure the latch assembly 10 to the door 8.

The rotating claw 14 is mounted rotatably about the claw pivot pin 26 and includes a mouth 32 for receiving the striker 24. The rotating claw 14 further includes a first safety abutment 38 and a closed abutment 40.

Figure 1A:
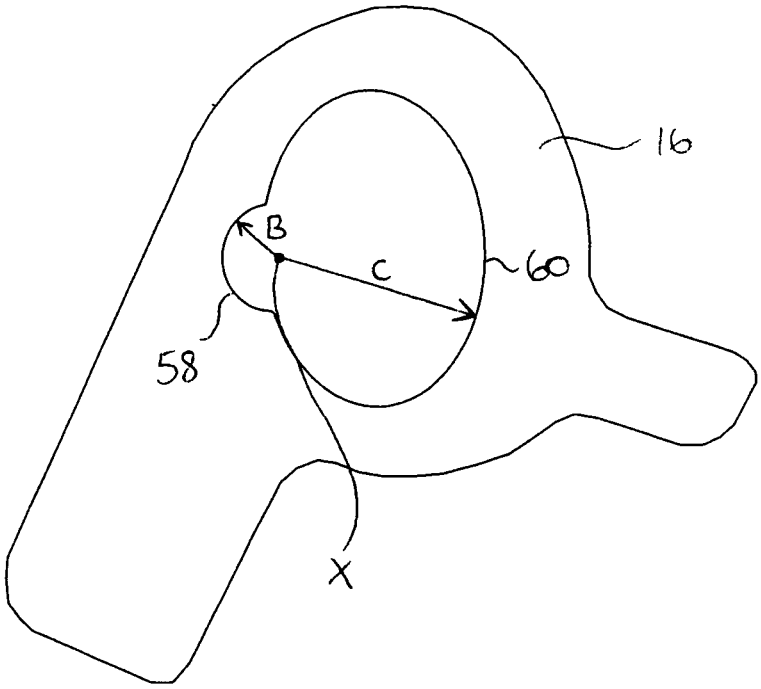
FIG. 1A is a backplate side view of a pawl of FIG. 1.
Figure 1B:
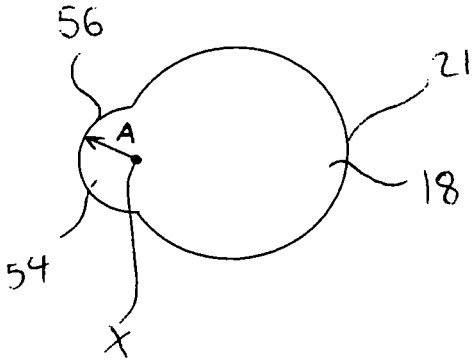
FIG. 1B is a latch plate side view of the pawl of FIG. 1.

The pawl 16 is generally planar and includes a claw abutment 46 and a chassis abutment 48. The pawl 16 further includes a pawl pivot pin orifice 50. The pawl pivot pin orifice 50 includes a second arcuate portion 58 of a radius B and a third arcuate portion 60 of radius C. Referring to FIGS. 1A and 1B, these arcuate portions 56, 58 and 60 and their radii can be seen in more detail. It will be appreciated that all three arcuate portions 56, 58 and 60 have a substantially common origin, that is, a pawl axis X about which the pawl 16 rotates. It should also be noted that the radius A and the radius B are substantially similar such that the pawl 16 can rotate relative to the pawl pivot pin 18 about the pawl axis X.

There is also provided an actuator 62 (shown schematically) connected to an actuator rod 64, which is in turn connected to the pawl 16. Actuation of the actuator 62 retracts the actuator rod 64 such that the pawl 16 rotates in a clockwise direction against the bias of a spring 66.

Figure 2:
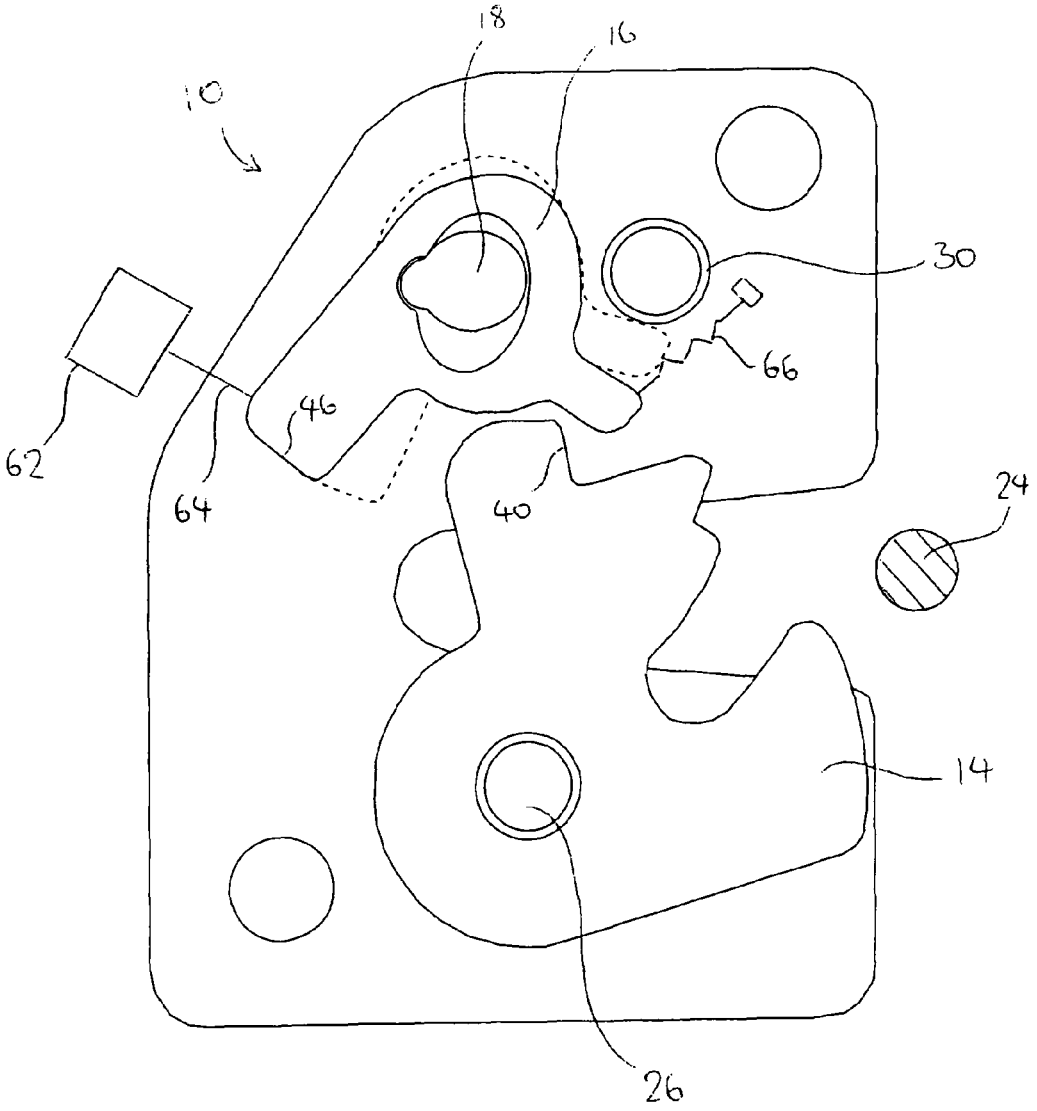
FIG. 2 is a backplate side view of the latch assembly of FIG. 1 in a released position.

FIG. 2 shows the latch assembly 10 in a released position whereby the actuator 62 has rotated the pawl 16 in a clockwise fashion in order to allow the rotating claw 14 to rotate in a clockwise fashion about the pawl axis X of the claw pivot pin 26. As can be seen, this rotation allows the striker 24 to be released from the latch assembly 10 (the position of the pawl 16 in the closed position is shown in dotted line for comparison).

The pawl 16 returns to a rest position after the closed abutment 40 of the rotating claw 14 has rotated past the claw abutment 46 of the pawl 16. In this case, the rest position is as shown in the dotted line i.e., it is the same as the closed position. The return to the closed position is aided by the spring 66. Alternatively or additionally, the actuator 62 could act in a reverse direction in order to allow the pawl 16 to return to its rest position.

Figure 3A:
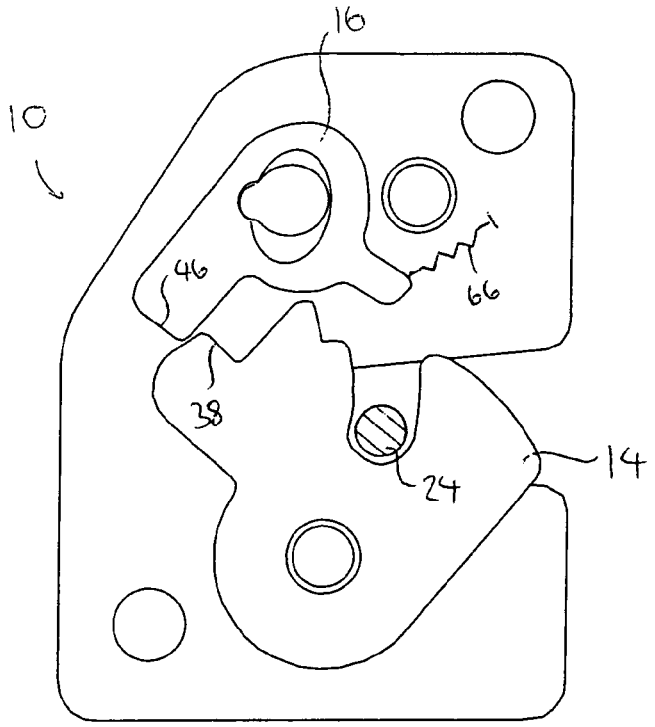
FIG. 3A is a backplate side view of the latch assembly of FIG. 1 in a semi closed position.
Figure 3B:
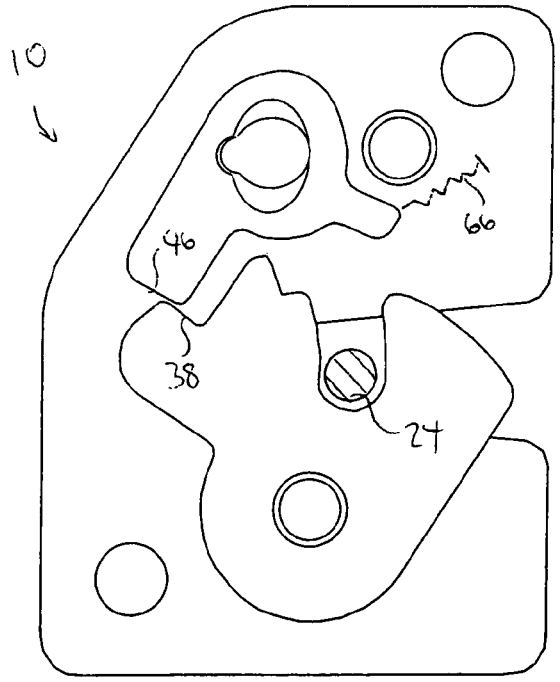
FIG. 3B is a backplate side view of the latch assembly of FIG. 1 in a position between the semi closed position of FIG. 3A and a first safety position.
Figure 3C:
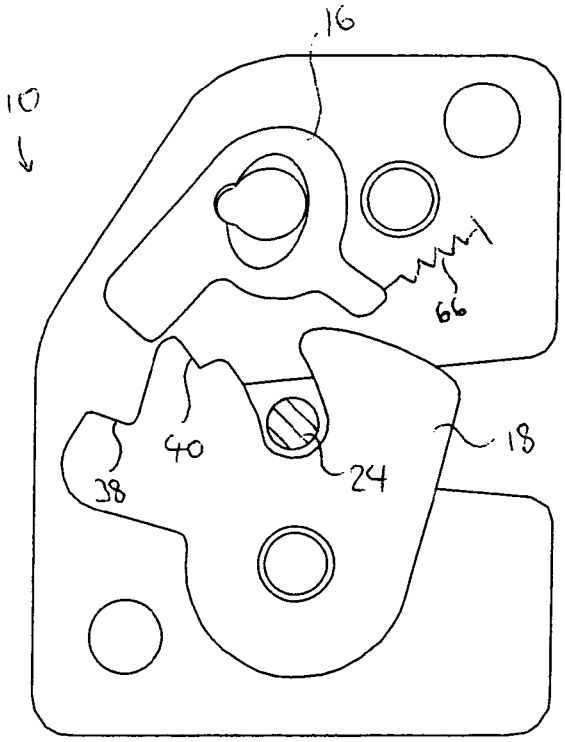
FIG. 3C is a backplate side view of the latch assembly of FIG. 1 in a semi-closed position between the first safety position and the closed position.
Figure 3D:
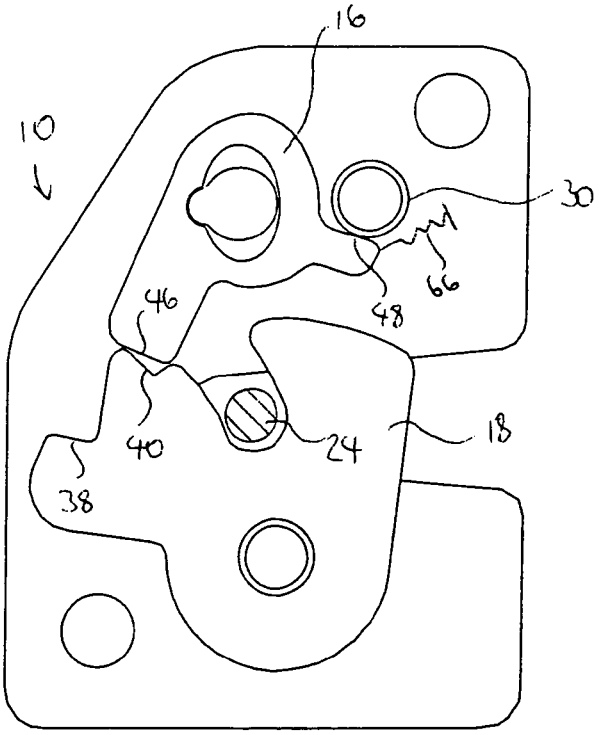
FIG. 3D is a backplate side view of the latch assembly of FIG. 1 in a fully closed position.

FIGS. 3A to 3D show the latch assembly 10 moving from the released state shown in FIG. 2 to the closed state shown in FIGS. 1 and 3D. Closure of the latch assembly 10 is enabled by movement of the striker 24 relative to the latch assembly 10 from the right to the left when viewing FIGS. 3A to 3D. This corresponds to a closing of the door 8. As can be seen in FIG. 3A, the movement of the striker 24 tends to rotate the rotating claw 14 in a counter-clockwise direction. This in turn rotates the pawl 16 in a clockwise direction from the rest position of FIG. 2 against the bias of the spring 66 until the first safety abutment 38 has passed the claw abutment 46 of the pawl 16. In the position shown in FIG. 3B, the latch assembly 10 is approaching a first safety condition whereby the first safety abutment 38 is about to engage the claw abutment 46.

As the striker 24 moves further to the left in FIG. 3C, the pawl 16 begins again to rotate in a clockwise sense against the bias of the spring 66 until the rotating claw 14 reaches a closed position as shown in FIG. 3D and the bias of the spring 66 returns the pawl 16 to the closed position whereby the claw abutment 46 is engaged with the closed abutment 40 of the rotating claw 14. The chassis abutment 48 of the pawl 16 engages with the stop pin 30 such that the pawl 16 cannot rotate any further. The latch assembly 10 is now back in the closed condition, as shown in FIG. 1.

Figure 4A:
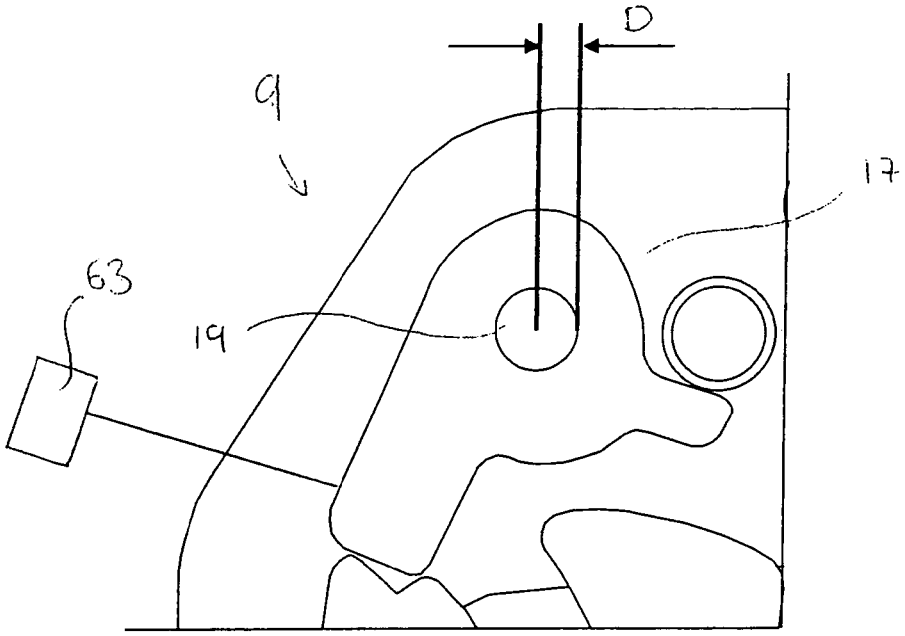
FIG. 4A is a schematic view of a prior art latch.
Figure 4B:
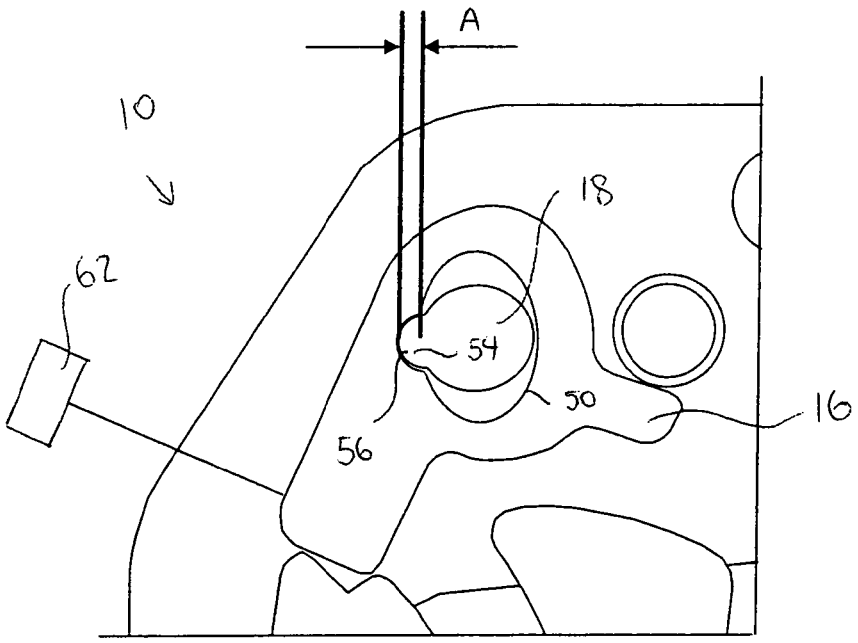
FIG. 4B is a detailed view of the latch assembly of FIG. 1.

Comparing FIGS. 4A and 4B, FIG. 4A shows a schematic view of a method of mounting a pawl 17 to a latch chassis via a pawl pivot pin 19 of a radius D. The radius D of the pawl pivot pin 19 needs to be sufficient to withstand the forces transmitted through the latch both in normal use and in high load events, for example, vehicle crash events. It will be appreciated that as the radius D is increased, the effective contact area between the pawl pivot pin and the pawl 17 is increased. The resulting increase in contact area between these two components means that a higher amount of dust and contaminants are able to infiltrate the contact area during the service life of the latch, resulting in the requirement for a higher force required to rotate the pawl 17 in a clockwise sense in order to release the latch. Therefore, the actuator 63 has to be of sufficient size to overcome these frictional forces.

Referring now to FIG. 4B, the radius of contact between the pawl pivot pin 18 and the pawl 16 is defined by the radius A of the first arcuate portion 56 of the pawl pivot pin 18. Furthermore, the geometry of the pawl pivot pin orifice 50 is such that only a segment of the circle defined by radius A of the first arcuate portion 56 is in contact between the pawl pivot pin 18 and the pawl 16. Therefore, the contact area, and consequently the effect of the ingress of dust and contaminants, is significantly reduced, reducing the load required to rotate the pawl 16 and therefore the size of the actuator 62.

It will also be noted that if the radius D of a known pawl pivot pin 19 was simply reduced, then the required strength would not be achieved in order to resist the loading requirements of the latch assembly 9. The present invention overcomes this problem by providing a pawl pivot pin 18 of significant size with the cylindrical body 52 and the lug 54 on which the first arcuate portion 56 is defined. Therefore, the pawl pivot pin 18 is able to resist the required loading, while also reducing the frictional forces between the pawl pivot pin 18 and the pawl 16.

Figure 5:
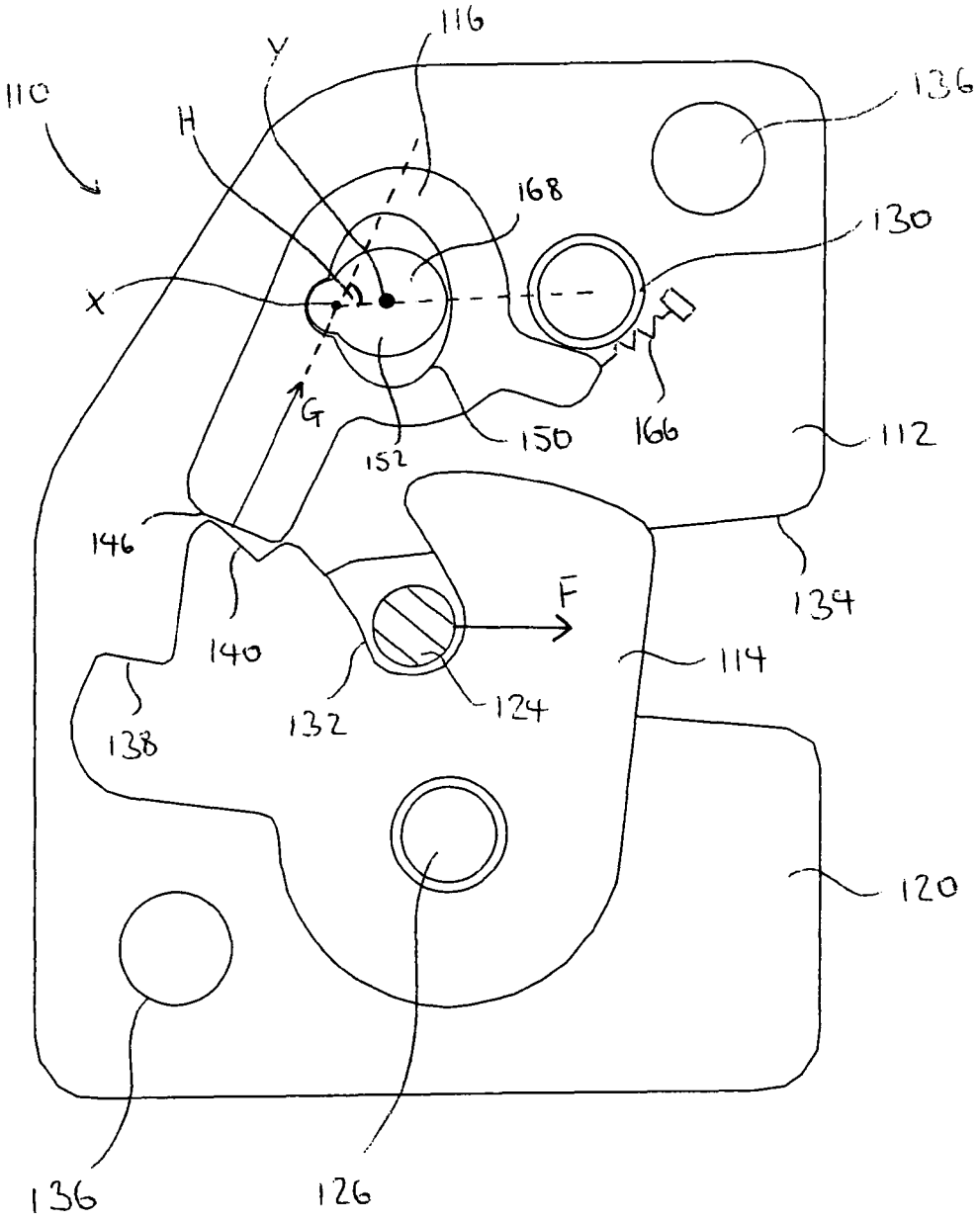
FIG. 5 is a backplate side view of certain components of a second embodiment of a latch assembly according to the present invention in a closed position.

FIG. 5 shows a second embodiment of a latch assembly 110. The latch assembly 110 is similar to the latch assembly 10 with common components having reference numerals of the latch assembly 10, but 100 greater.

Figure 6:
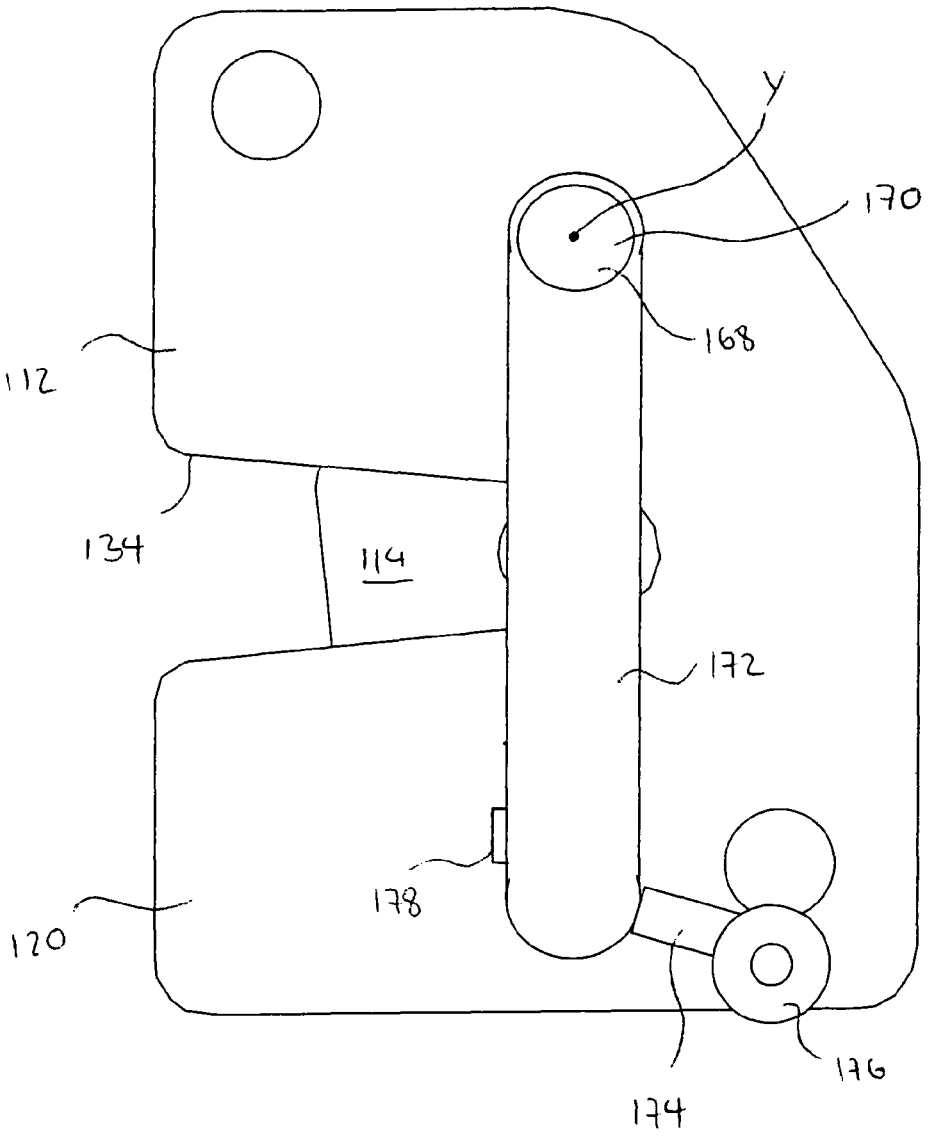
FIG. 6 is a retention plate side view of the latch of FIG. 5 in a closed position.

The latch assembly 110 includes a pawl 116 substantially identical to the pawl 16 of the latch assembly 10. However, a pawl pivot pin 168 differs from the pawl pivot pin 18 in that it is rotatably mounted on a latch chassis 112 such that it is able to rotate about a pivot axis Y (as mentioned above, the pawl pivot pin 18 is non-rotatably fixed to the latch chassis 12). Referring to FIG. 6, this rotation is brought about by a cylindrical portion 170 (an extension of a cylindrical body 152) of the pawl pivot pin 168, which passes through a retention plate 120. It will therefore be appreciated that the pawl pivot pin 168 forms an eccentric as the pawl axis X and the pivot axis Y are offset.

As shown in FIG. 6, a lever 172 is connected to the cylindrical portion 170 of the pawl pivot pin 168 on a side of the retention plate 120 opposite to the pawl 116. The lever 172 is held in position by a moveable abutment 174 which is configured to be displaced in a downwardly direction by an actuator 176. The lever 172 is prevented from moving clockwise when viewing FIG. 6 by a lever abutment 178.

Figure 7A:
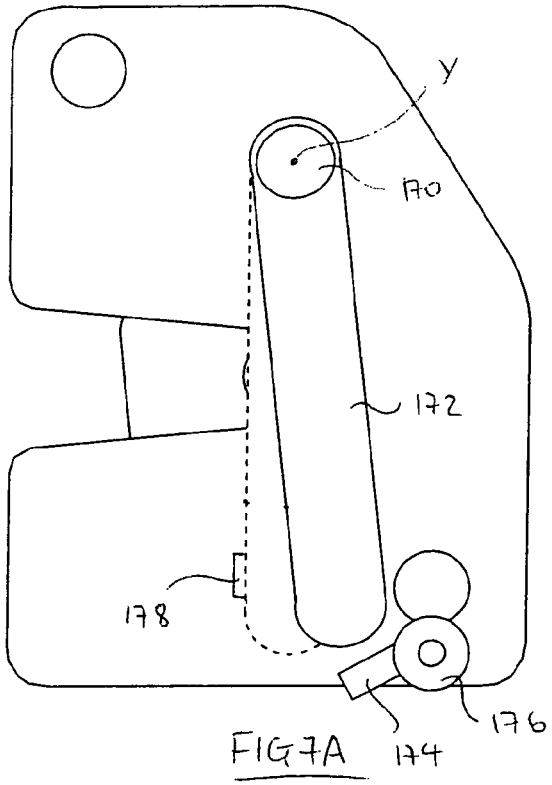
FIG. 7A is a retention plate side view of the latch assembly of FIG. 5 in a released position.
Figure 7B:
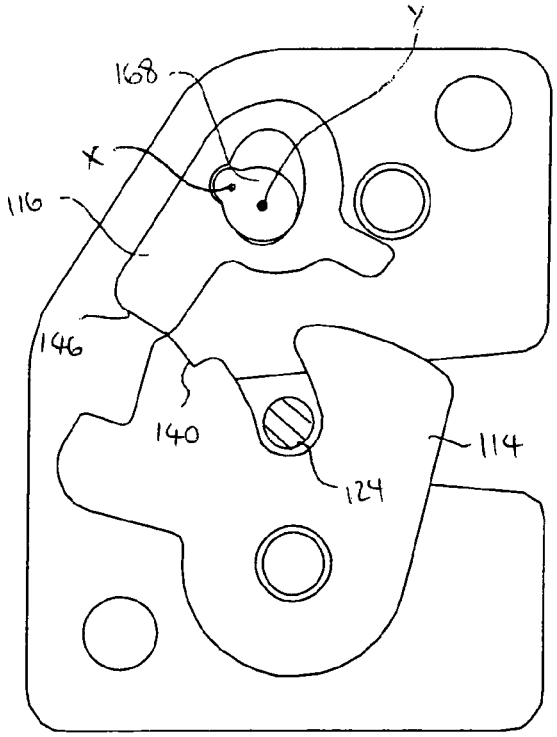
FIG. 7B is a backplate side view with the latch assembly of FIG. 5 in a released position.

In the closed position as shown in FIG. 5, the seal loads between the door and the vehicle frame result in a striker 124 exerting a force F on a mouth 132 of a claw 114. This in turn results in a force being applied by a closed abutment 140 of the claw 114 onto a claw abutment 146 of the pawl 116. This force is denoted by G in FIG. 5. It should be noted that the force G does not pass through the pivot axis Y, and as such the torque is applied to the pawl pivot pin 168 in a clockwise fashion with respect to FIG. 5. This results in a counter-clockwise torque when viewing FIG. 6 on the pawl pivot pin 168 and consequently the lever 172. This motion is inhibited by the presence of the moveable abutment 174, and as such, the latch assembly 110 remains in a closed position. In order to open the latch assembly 110, the actuator 176 is actuated such that the moveable abutment 174 moves out of contact with the lever 172, as shown in FIG. 7A. Therefore, under the action of force G, the lever 172 rotates in a counter-clockwise fashion as shown in FIG. 7A, which is equivalent to a rotation in a clockwise sense of the pawl pivot pin 168 when viewing FIG. 7B. This motion can be seen by comparing the position of the pawl axis X in FIGS. 5 and 7B The resulting motion of the pawl 116 moves the claw abutment 146 out of engagement with the closed abutment 140, thus allowing the claw 114 to rotate in a clockwise sense and release the striker 124.

Figure 8:
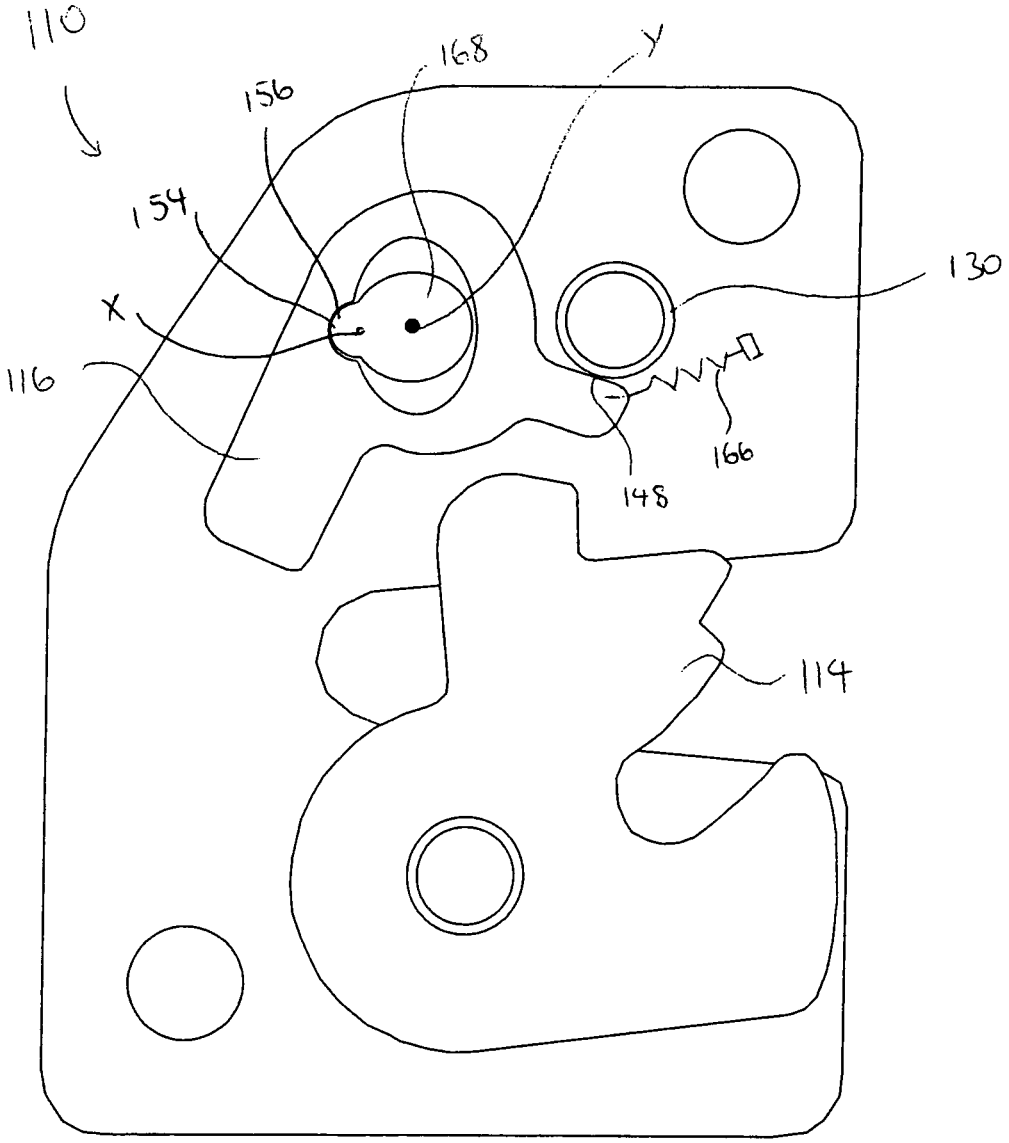
FIG. 8 is a backplate side view of the latch assembly of FIG. 5 in an open position.

As can be seen in FIG. 8, the latch assembly 110 is in an open condition with the claw 114 rotated such that the striker (not shown) is released. The lever 172 has returned to its original position against the lever abutment 178. The mechanism by which the lever 172 returns to its original position is by way of a reset abutment on the claw 114 (not shown), which rotates the pawl pivot pin 168 back to its original position as shown in FIG. 5. A more detailed explanation of the reset sequence may be found below (with respect to FIGS. 15A and 15B).

The moveable abutment 174 has also been returned to its original position in order to constrain the lever 172. It will be noted that pawl axis X is in the same position in FIGS. 5 and 8.

As there is no force G acting on the pawl 116, the pawl 116 is kept in position via the bias of a spring 166 holding a chassis abutment 148 against a stop pin 130. It will be noted that during release of the latch assembly 110, the chassis abutment 148 and the stop pin 130 are in constant contact, and in fact, the pawl 116 is able to rotate about the contact point between these two components.

Figure 9A:
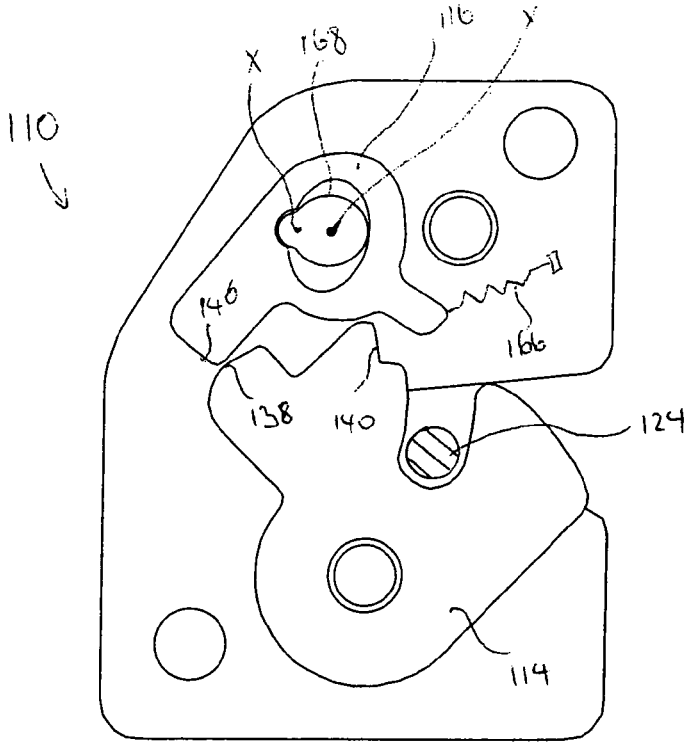
FIG. 9A is a backplate view of the latch assembly of FIG. 5 in a semi closed position.
Figure 9B:
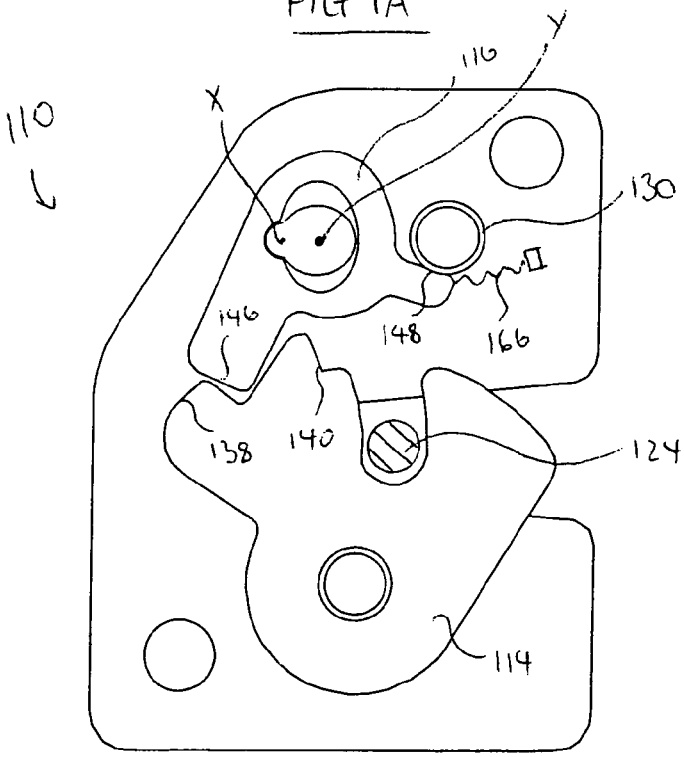
FIG. 9B is a backplate view of the latch assembly of FIG. 5 in a first safety position.
Figure 9C:
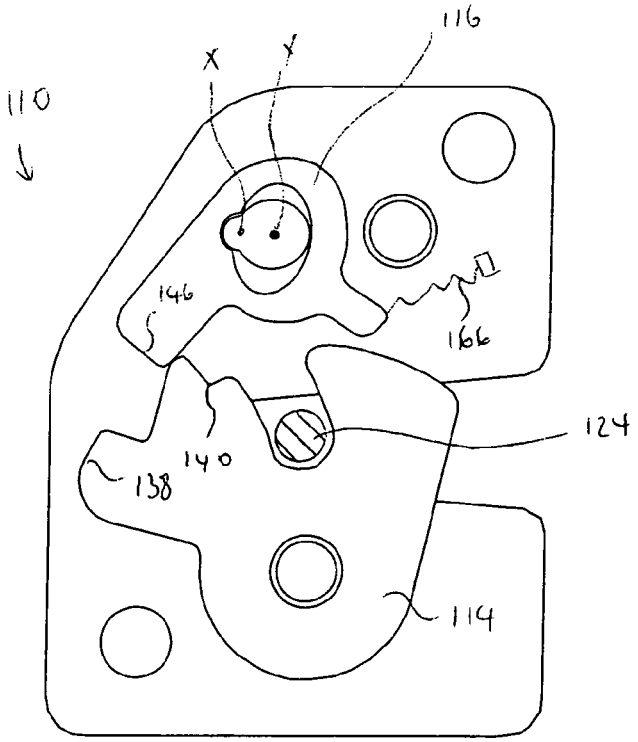
FIG. 9C is a backplate view of the latch assembly of FIG. 5 in a semi closed position between the first safety position and the closed position.
Figure 9D:
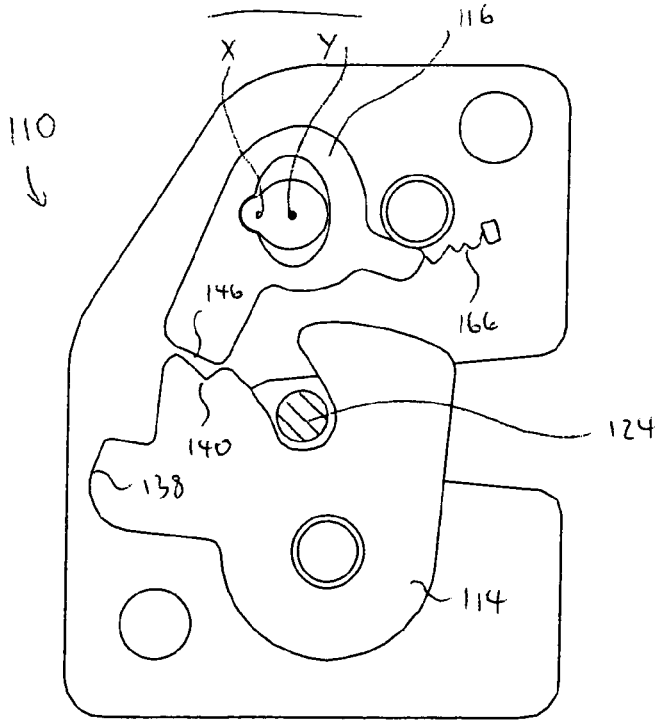
FIG. 9D is a backplate side view of the latch assembly of FIG. 5 in a fully closed position.

Referring to FIGS. 9A to 9D, the latch assembly 110 is shown moving from an open position as shown in FIG. 8 to a closed position as shown in FIG. 9D. In FIG. 9A, the striker 124 moves to the left, and as such, rotates the claw 114 in a counter-clockwise direction. Contact between a first safety abutment 138 and the claw abutment 146 causes the pawl 116 to rotate in a clockwise sense about the pawl axis X. The pawl 116 rotates against the bias of the spring 166.

FIG. 9B shows the position wherein the first safety abutment 138 has passed the claw abutment 146, and thus the pawl 116 returns to its reset position with the chassis abutment 148 contacting the stop pin 130. Further ingress of the striker 124 rotates the claw 114 further counter-clockwise as shown in FIG. 9C such that the closed abutment 140 acts on the claw abutment 146 in order to rotate the pawl 116 again. Rotation occurs until the closed abutment 140 passes the claw abutment 146 and the pawl 116 returns to its reset position, as shown in FIG. 9D. As the door is now in a shut condition, the seal loads F are restored (as shown in FIG. 5), and the latch assembly 110 is ready for release. It will be noted that when moving from the FIG. 8 position, through the FIG. 9A, 9B, 9C positions to the FIG. 9D position, the pawl axis X remains in the same position.

It will be appreciated that for the reasons described with respect to the latch assembly 10, the friction involved in rotating the pawl 116 relative to the pawl pivot pin 168 in the latch assembly 110 is significantly reduced. Therefore, opening of the latch assembly 110 (i.e., movement from the position shown in FIG. 5 to the position shown in FIG. 7) involves less frictional force, reducing the likelihood that the latch assembly 110 becomes stuck in the closed position. Furthermore, relative rotation between the pawl 116 and the pawl pivot pin 168 during closing (as shown in FIGS. 9A to 9D) is also reduced, making it significantly easier to close the latch assembly 110.

It will also be appreciated that these benefits come through the reduction in the radius A of a first arcuate portion 156 on a lug 154, as shown in FIG. 8. There is no associated loss in strength of the pawl pivot pin 168 due to its form incorporating the cylindrical body 152 and the lug 154.

The reduction in friction in the system results in a reduction in the aforementioned minimum backdrive angle. The start angle of the latch assembly 110 is indicated at H in FIG. 5. The present invention allows this angle to be reduced to levels significantly lower than known latches (i.e., the minimum backdrive angle is reduced) to levels in the order of 14.4 degrees (compared to known latches with, for example, minimum backdrive angles in the order of 54 degrees).

It will be appreciated that the latch assembly 110 is an arrangement in which the force G acts to the left of pivot axis Y in FIG. 5. Therefore, the latch assembly 110 is only held closed by the presence of the lever abutment 178 acting on the lever 172. It will be appreciated that the present invention extends to intrinsically stable latches, as will be described below.

A latch assembly 210 is substantially similar to the latch assembly 110 and common features have reference numerals 100 greater. The main difference between the latch assembly 110 and the latch assembly 210 is that a pawl pivot pin orifice 282 and a lug 284 are oriented differently to a pawl pivot pin orifice 150 and the lug 154. In this way, the latch assembly 210 is configured such that a force F acting from a striker 224 produces a force G resulting from the interaction between a closed abutment 240 and a claw abutment 246 such that the force G acts directly through both the pawl axis X and the pivot axis Y. As such, a pawl pivot pin 218 acts as a crank arm at a top dead center position i.e., in unstable equilibrium. No resulting torque is felt on either a pawl 216 or the pawl pivot pin 218 as a result of the force G, however movement of the force G to either side of the pivot axis Y will result in a torque being produced on the pawl 216.

Figure 11:
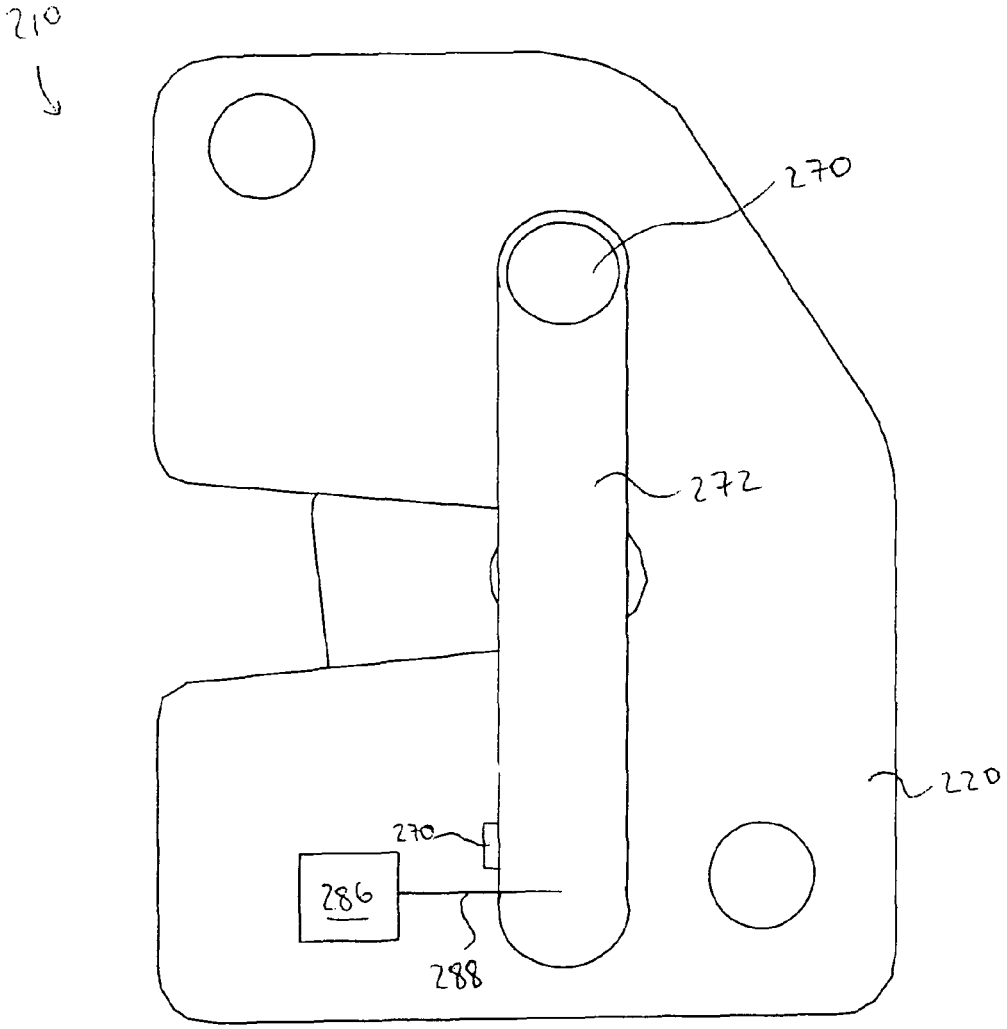
FIG. 11 is a retention plate side view of the latch assembly of FIG. 10.

Referring to FIG. 11, an actuator 286 including an actuation member 288 is connected to a lever 272. The lever 272 sits against a lever abutment 278 mounted onto a latch retention plate 220.

In order to release the latch assembly 210, the actuator 286 is actuated such that the actuator member 288 rotates the lever 272 in a counter-clockwise direction when viewing FIG. 11. This results in a rotation of the pawl pivot pin 218 in a clockwise direction shown in FIG. 10 about the pivot axis Y. The line of action of force G therefore moves to the left of the pivot axis Y and acts to further rotate the pawl pivot pin 218 in order to release the latch assembly 210 in the same manner as described for the latch assembly 110. The latch assembly 210 is reset in a similar way to the latch assembly 110 (and as such as described below with respect to FIGS. 15A and 15B).

Figure 10:
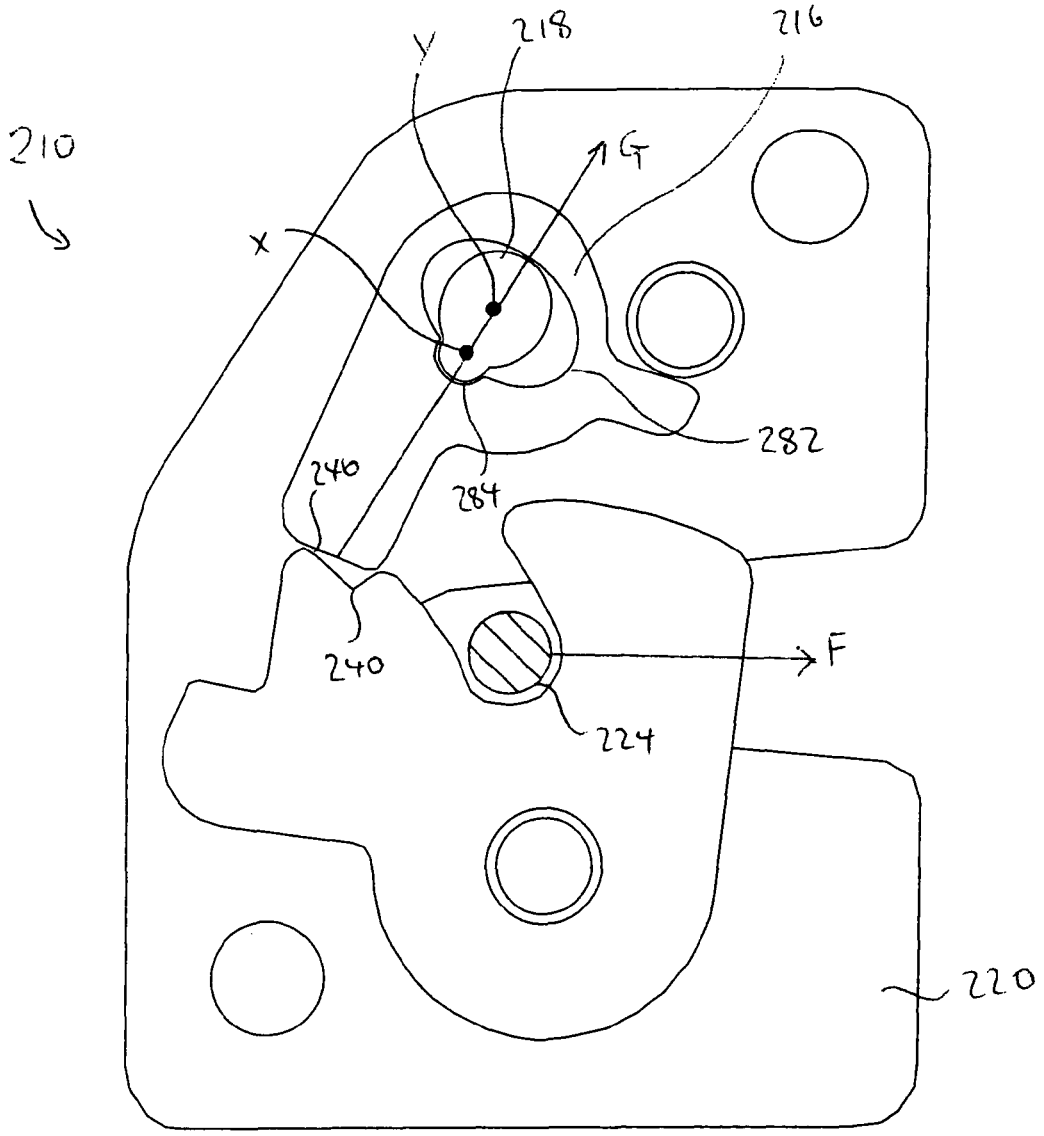
FIG. 10 is a backplate side view of certain components of a third embodiment of a latch assembly according to the present invention.

The latch assembly 210 is closed in substantially the same was as the latch assembly 110. It should be noted that as well as an arrangement whereby the pawl pivot pin 218 is held at top dead center as shown in FIG. 10, a lever abutment 270 could be relocated such that the pawl pivot pin 218 sits at over top dead center; i.e., force G acts to the right of pivot axis Y. This provides an even more stable arrangement whereby it would be necessary to rotate the pawl pivot pin 218 such that the line of action of the force G passes through the pivot axis Y and beyond in order to unlatch the latch assembly 210.

As described with the latch assemblies 10 and 110, the latch assembly 210 exhibits the same beneficial effects of the presence of the lug 284. Generally, latch friction is reduced, and as such, the latch assembly 210 is easier to operate, requiring smaller actuators thereby reducing latch size.

It will be noted that the relative sizes of the pawl pivot pin 18, 168, 218 and the pawl pivot pin orifice 50, 150, 282 can be varied to both permit and limit the relative motion between the pawl pivot pin and the pawl 16, 116, 216. As seen in all of the above embodiments and specifically with reference to the latch assembly 10, the pawl pivot pin 18 contacts the pawl 16 at a contact point 21 distant from the lug 54. The contact point 21 is able to slide across the third arcuate portion 60 in order to increase stability of the latch assembly 210 and prevent excessive relative movement between the pawl pivot pin 18 and the pawl 16.

Figure 12:
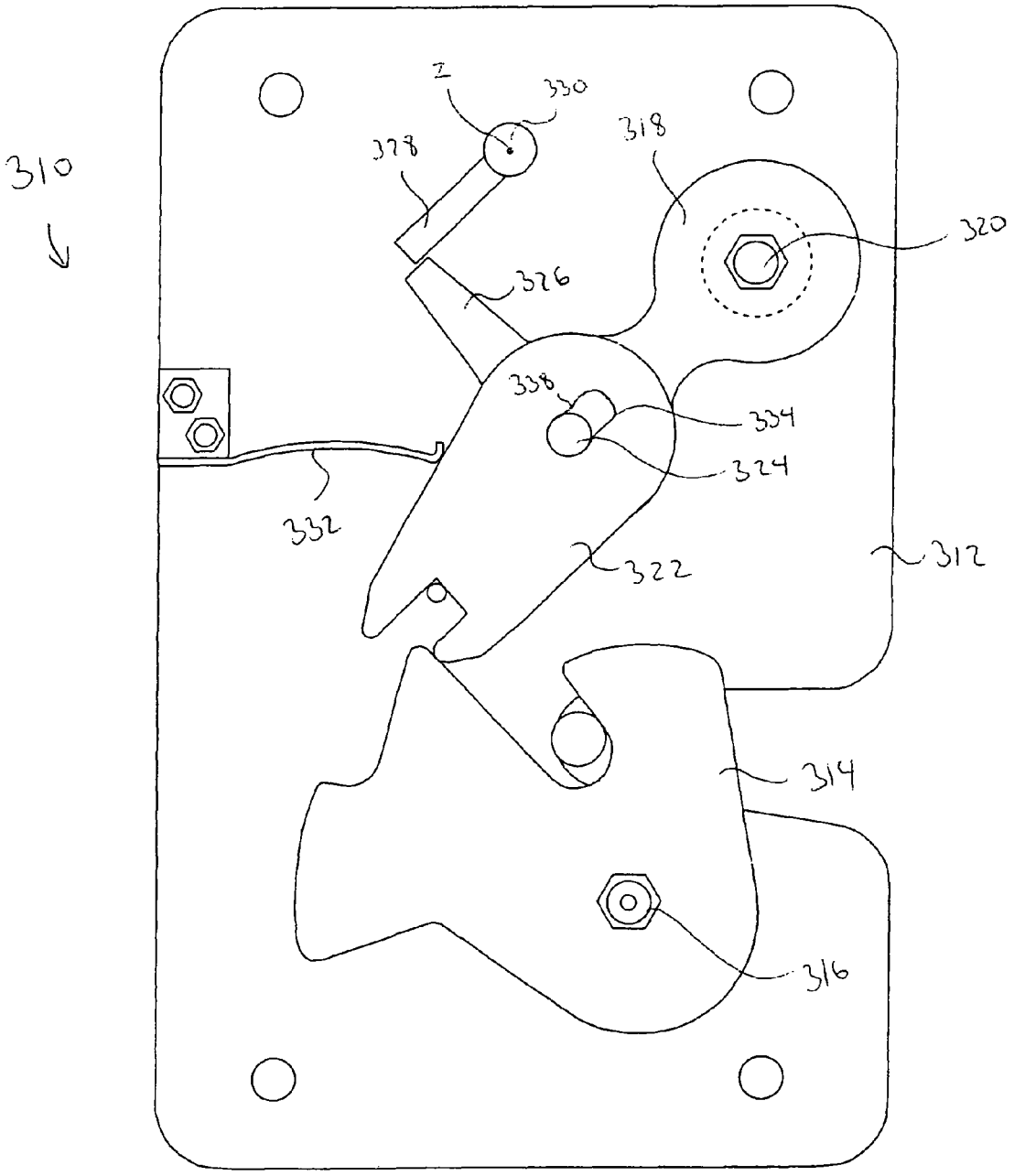
FIG. 12 is a backplate side view of certain components of a fourth embodiment of a latch assembly according to the present invention in a closed position.
Figure 13:
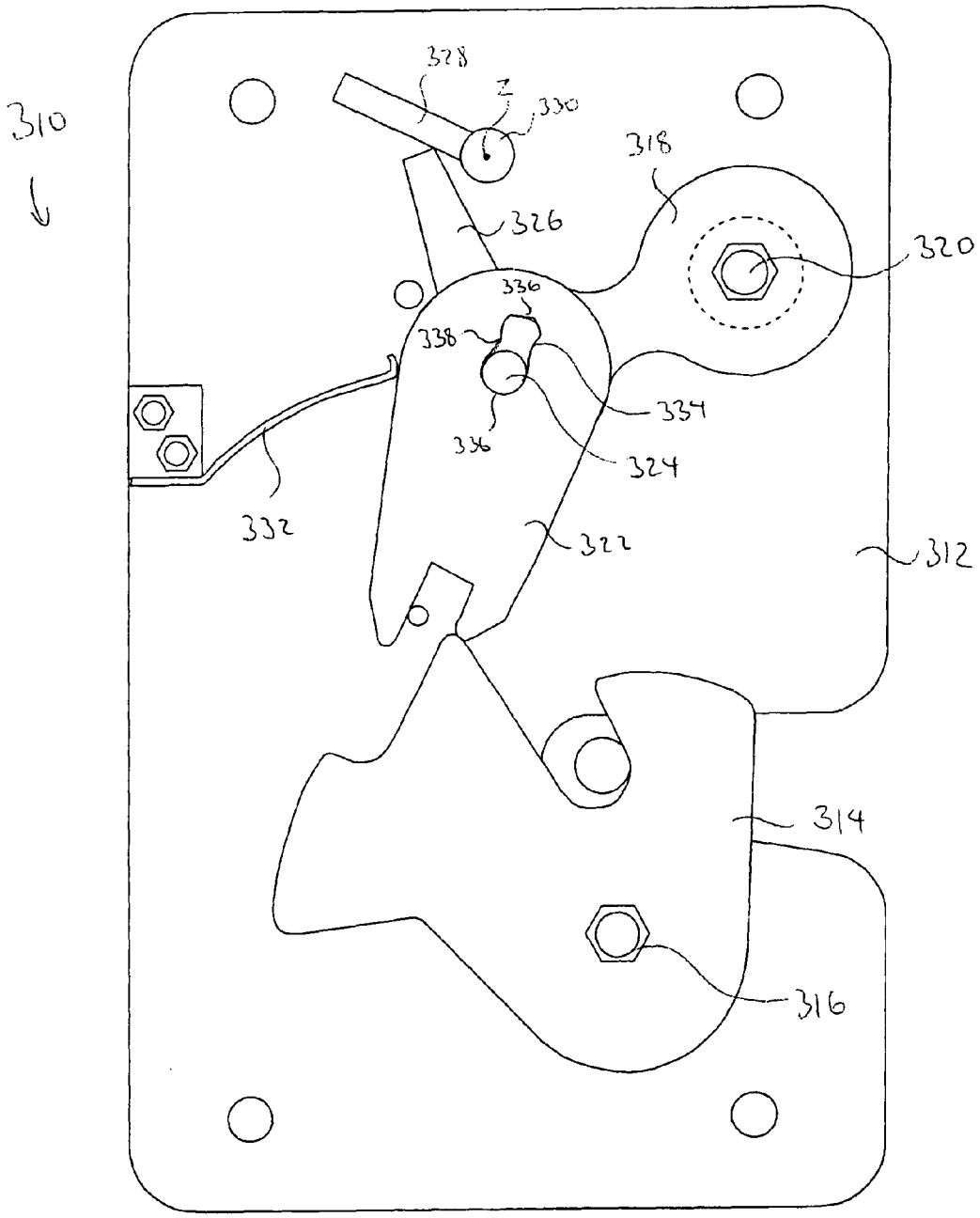
FIG. 13 is a backplate side view of the latch assembly of FIG. 12 in a released position.

Referring to FIGS. 12 and 13, in a fourth embodiment of the present invention, a latch assembly 310 is shown. The latch assembly 310 operates in substantially the same way as the latch assembly 110 and includes a latch chassis 312 onto which are mounted a claw 314 rotating about a claw pin 316, a toggle member 318 rotating about a toggle pin 320, and a pawl 322 rotatable about a pawl pivot pin 324 mounted on the toggle member 318.

The toggle member 318 includes a toggle abutment 326, which engages a moveable abutment 328 mounted onto the latch chassis 312 via an actuator 330 to rotate about an abutment axis Z. The pawl 322 and the toggle member 318 are biased into the position shown in FIG. 12 via a spring 332. In known arrangements (e.g., GB2409706), the pawl pivot pin is rotatable in a pawl pin orifice, which is often circular and of a diameter similar to the pawl pivot pin.

In the present embodiment, there is provided a pawl pin orifice 334 in the shape of an obround with opposing end semi circle portions 336 of diameter substantially equal to a diameter of the pawl pivot pin 324. The pawl pin orifice 334 further includes a neck 338 of a width that is substantially less than a diameter of the pawl pivot pin 324. As such, the pawl pivot pin 324 is held in position relative to the pawl 322. This can be seen in comparing FIGS. 12 and 13, whereby the actuator 330 has been actuated such that the moveable abutment 328 moves out of the way of the toggle abutment 326 and allows the toggle member 318 and the pawl 322 to collapse to a position whereby the claw 314 may rotate and release the associated striker.

It can be clearly seen that the contact area between the pawl pivot pin 324 and the pawl pin orifice 334 is substantially less than if the pawl pin orifice was circular. As such, the frictional effect of dust and contaminants in this rotational joint is substantially reduced, and effort required to open and close the latch is also reduced. No reduction in the necessary size of the pawl pivot pin 324 has been made, only an increase in the size of the pawl pin orifice 334. It should also be noted that the action of rotation of the pawl pivot pin 324 in the pawl pin orifice 334 will tend to force dust and contaminants from the mating areas of the two components into the empty parts of the pawl pin orifice 334 proximate the neck 338.

All of the above embodiments utilize dead pivots; i.e., the pawl includes a pawl pin orifice in which the pawl pivot pin rotates relative to the pawl. In such devices, the pawl pin orifice is defined in the pawl. The present invention also extends to live pivot arrangements; i.e., where the pawl pivot pin is fixably mounted to, or integral with, the pawl so it cannot rotate or otherwise move relative to the pawl. The pawl pin orifice is therefore defined in the component on which the pawl is rotatably mounted (e.g., the latch chassis, eccentric or toggle).

Figure 14A:
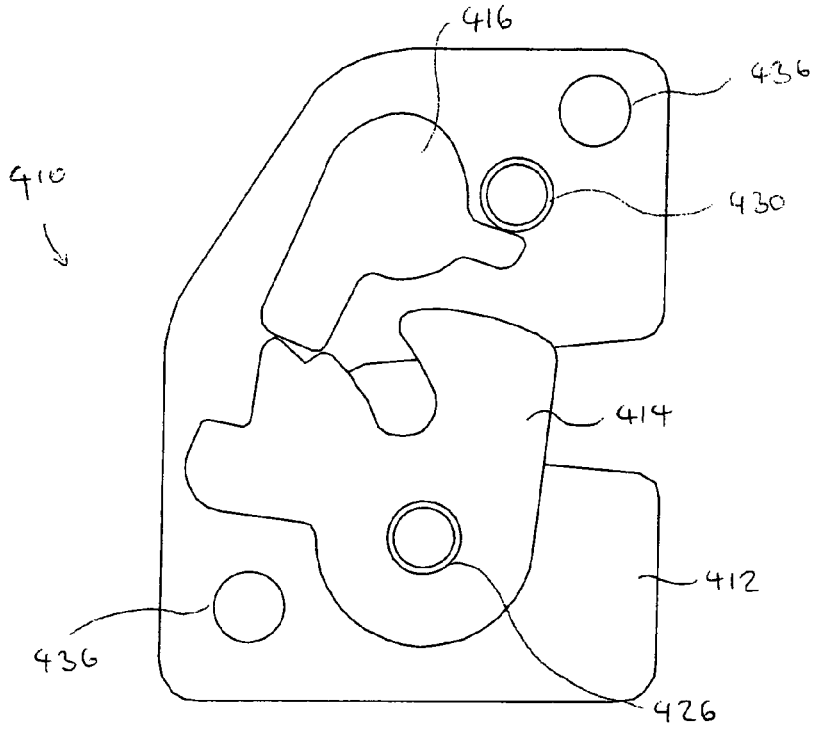
FIG. 14A is a backplate side view of certain components of a fifth embodiment of a latch assembly according to the present invention in a closed position.
Figure 14B:
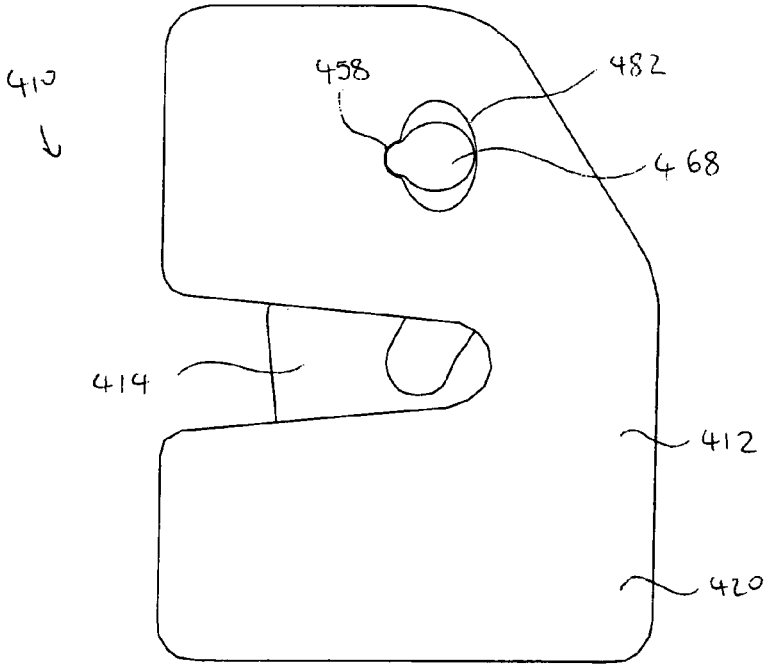
FIG. 14B is a retention plate side view of the latch assembly of FIG. 14A in a closed position.

The latch assembly 410 as seen in FIGS. 14A and 14B utilizes a live pivot arrangement. Components are substantially similar to the latch assembly 10, 400 greater, with the exception of the latch retention plate 420 and the pawl 416. In the case of the latch assembly 410, the pawl 416 is integral with a pawl pivot pin 468 protruding from the retention plate side thereof (as may be seen in FIG. 14B). The latch retention plate 420 includes a pawl pin orifice 482 similar in shape to the pawl pivot pin orifice 50, although defined on the latch retention plate 420 and with the second arcuate portion facing in the opposite direction to the second arcuate portion 58.

In operation, the latch assembly 410 operates in substantially the same way as the latch assembly 10, with the exception that the pawl pivot pin 468 rotates relative to the latch retention plate 420, and remains stationary relative to the pawl 416.

Figure 14C:
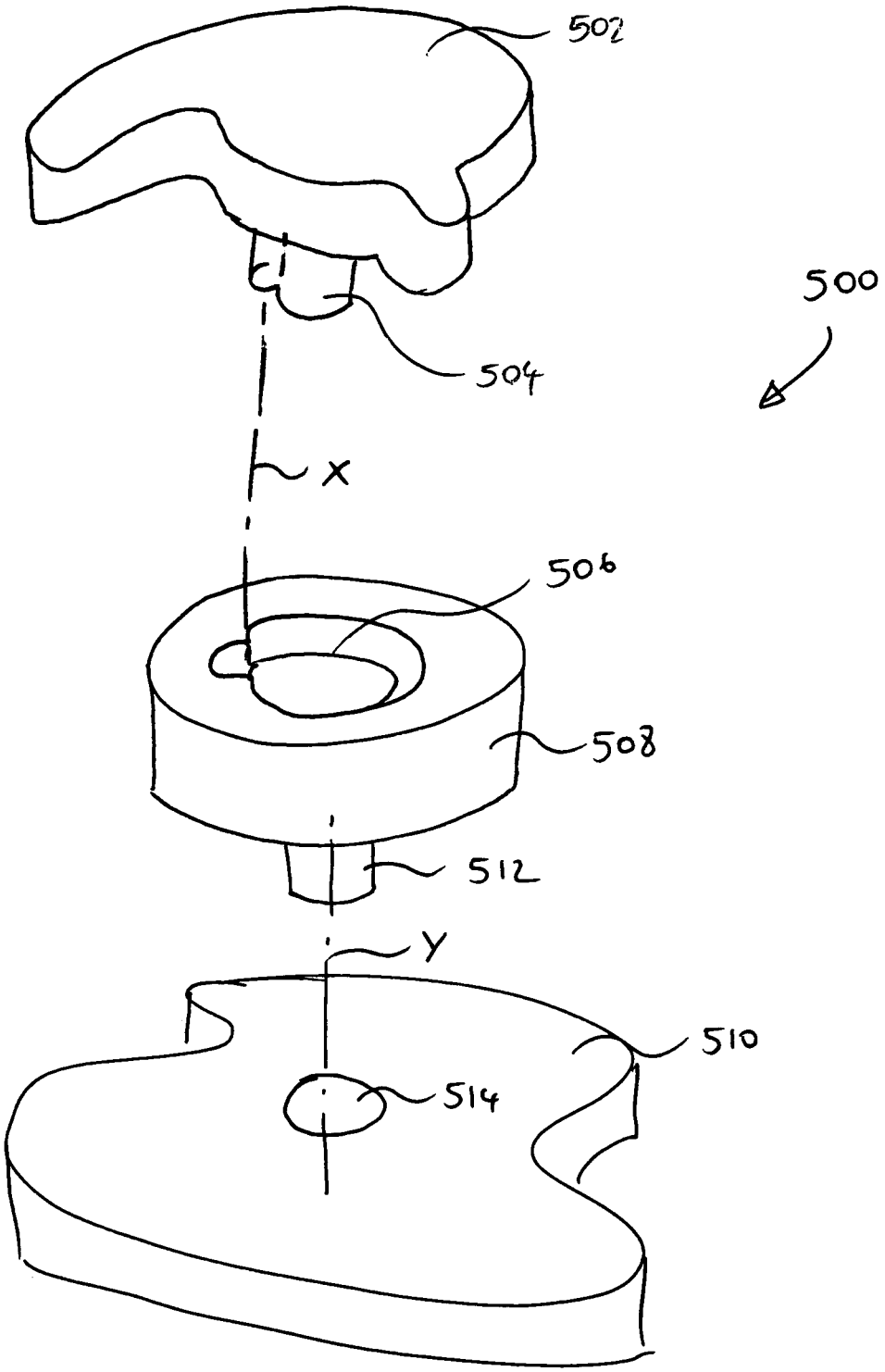
FIG. 14C is an exploded view of certain components of a sixth embodiment of a latch assembly according to the present invention.

A latch subassembly 500 as seen in FIG. 14C also utilizes a live pivot arrangement. A pawl 502 defines a pawl pivot pin 504 which is inserted into a pawl pin orifice 506 defined in an eccentric 508 such that the pawl 502 rotates about a pawl axis X. The eccentric 508 is rotationally mounted to a chassis 510 via the interaction of an eccentric pin 512 and an eccentric pin orifice 514 defined in the chassis 510. As such, the eccentric 508 rotates about a pivot axis Y. This arrangement could be used instead of the dead pivot arrangement shown in latch assembly 110, for example.

Figure 15A:
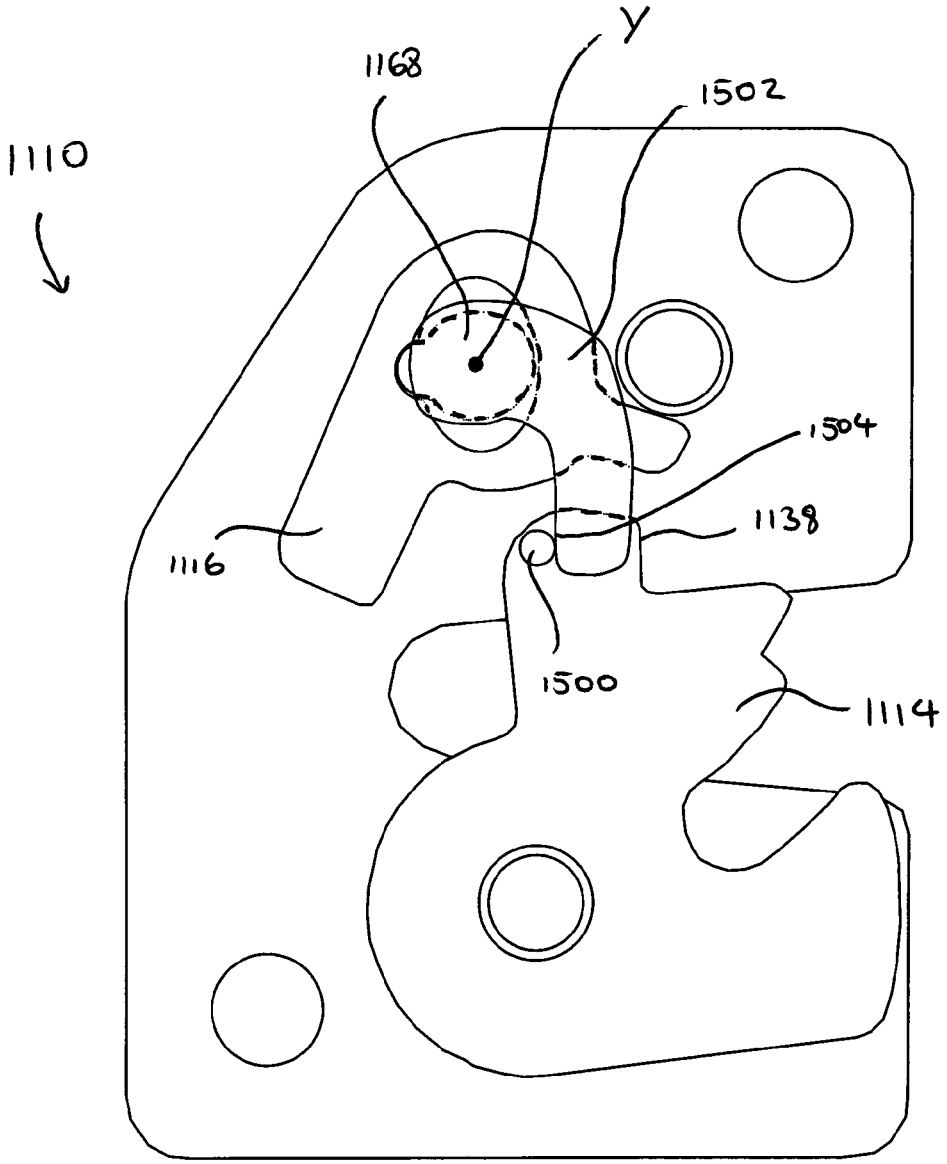
FIG. 15A is a backplate side view of certain components of a seventh embodiment of a latch assembly according to the present invention in an open position.
Figure 15B:
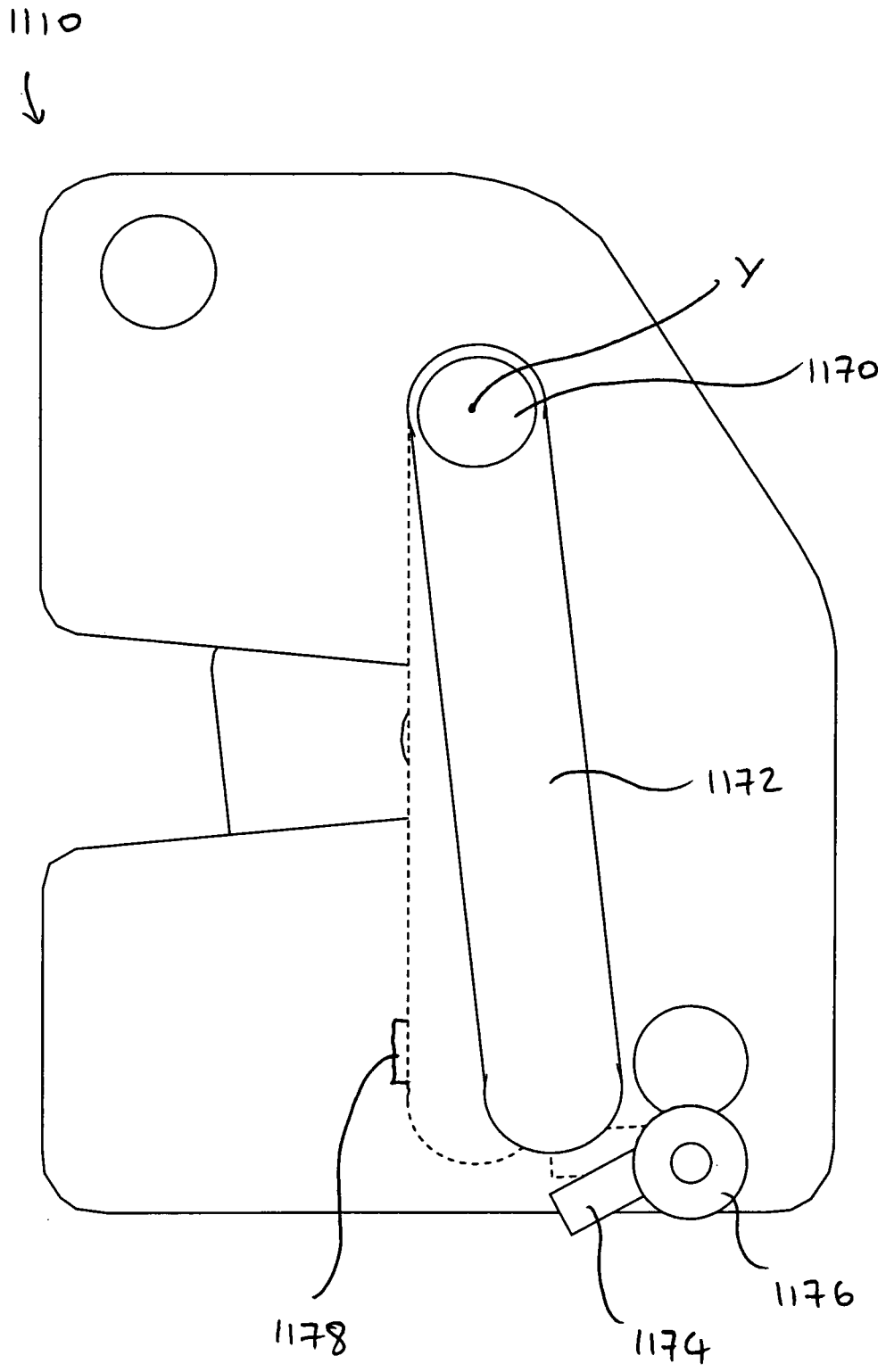
FIG. 15B is a retention plate side view of the latch assembly of FIG. 15A in an open position.

An example reset mechanism is shown in FIGS. 15A and 15B with respect to a latch assembly 1110, which is substantially similar to the latch assembly 110 with reference numerals 1000 greater. In addition to the latch assembly 110, the latch assembly 1110 is provided with a reset pin 1500 defined on a claw 1114 and a reset lever 1502 mounted fast to a pawl pivot pin 1168 such that it rotates about the pivot axis Y with the pawl pivot pin 1168. A reset abutment 1504 is defined on the reset lever 1502.

As mentioned, upon opening once the claw 1114 has rotated clockwise with the first safety abutment 1138 passing the pawl 1116, the claw 1114 is then free to rotate to the fully open position as shown in FIG. 15A. In doing so, the reset pin 1500 engages and then moves the reset abutment 1504 of the reset lever 1502. This in turn rotates the pawl pivot pin 1168 from the position shown in FIG. 7B (with respect to pawl pivot pin 168) to the position shown in FIG. 15A, thereby resetting the pawl axis X to the equivalent position (with respect to pawl pivot pin 168) as shown in FIG. 8. At the same time, with reference to FIG. 15B, a release lever 1172 is returned to the position shown in hidden line, abutting a moveable abutment 1174. The latch assembly 1110 is now reset.

It will be understood that the pawl pin orifice may be defined in either or both of the retention plate and backplate and for optimum strength will be defined in both.

It is envisaged that other live pivot arrangements fall within the scope of the present invention. For example, the pawl pin orifice could be formed in an eccentric with the pawl pivot pin (integral with the pawl) rotatably mounted therein.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

The invention claimed is:

1. A latch assembly comprising:

a chassis;

a latch bolt, movably mounted on the chassis and having a closed position for retaining a striker and an open position for releasing the striker; and a pawl having an engaged position at which the pawl is engaged with the latch bolt to hold the latch bolt in the closed position and a disengaged position at which the pawl is disengaged from the latch bolt, thereby allowing the latch bolt to move to the open position, wherein the pawl is rotatably mounted to the latch assembly via a pawl pivot pin secured to the chassis, wherein the pawl rotates about a pawl axis of the pivot pin, and wherein the pawl pivot pin includes a first arcuate portion along a peripheral edge of the pawl pivot pin, the first arcuate portion having a first radius from the pawl axis, and wherein the pawl pivot pin has a second arcuate portion extending from the first arcuate portion, a portion of the second arcuate portion having a second radius, the second radius being greater than the first radius and wherein a peripheral area of the pawl pivot pin defined by the first arcuate portion and the second arcuate portion, is greater than an area of a circle defined by the first radius, wherein friction between the pawl and the pawl pivot is reduced as the pawl primarily contacts the first arcuate portion.

2. The latch assembly according to claim 1 wherein the pawl pivot pin is an eccentric rotatably mounted to the chassis about an eccentric axis that is parallel to and offset from the pawl axis, wherein, when the pawl moves from the engaged position to the disengaged position, the eccentric rotates in one of a clockwise direction and a counter-clockwise direction about the eccentric axis, and wherein, with the pawl in the engaged position, a force applied to the pawl by the latch bolt creates a turning moment on the eccentric about the eccentric axis in the one of a clockwise direction and a counter-clockwise direction, and wherein the latch assembly further comprises a rotation prevention feature for movement between a blocking position and an unblocking position wherein the eccentric is prevented from rotating in the one of a clockwise direction and a counter-clockwise direction when the rotation prevention feature is in the blocking position.

3. The latch assembly according to claim 2 wherein the first arcuate portion of the pawl pivot pin is configured to provide a bearing surface to rotate the eccentric in the one of a clockwise direction and a counter-clockwise direction.

4. The latch assembly according to claim 1 wherein the pawl pivot pin is fixed relative to the pawl.

5. The latch assembly according to claim 1 wherein the pawl pivot pin is fixed relative to the chassis.

6. The latch assembly according to claim 1, wherein the pawl has a pawl pin orifice for rotatably receiving the pawl pin therein, the pawl pin orifice having an arcuate portion for receiving the first arcuate portion of the pawl pin therein, the arcuate portion of the pawl pin orifice being defined by a radius from the pawl axis, the radius of the arcuate portion of the pawl pin orifice being substantially similar to the first radius of the pawl pin, and wherein a peripheral area of the pawl pin orifice, is greater than an area of a circle defined by the radius of the arcuate portion of the pawl pin orifice.

7. The latch assembly according to claim 6 wherein the first arcuate portion of the pawl pivot pin is a lug in contact with the arcuate portion of the pawl pin orifice.

8. The latch assembly according to claim 7 wherein the pawl pin orifice further comprises another arcuate portion extending from the arcuate portion of the pawl pin orifice, a portion of the another arcuate portion having a radius from the pawl axis, wherein the radius of the another arcuate portion is larger than the first radius and the second radius, and the pawl pivot pin is in contact with the another arcuate portion of the pawl pin orifice as the pawl moves from the engaged position to the disengaged position.

9. A latch assembly comprising:

a chassis;

a latch bolt, movably mounted on the chassis and having a closed position for retaining a striker and an open position for releasing the striker; and a pawl having an engaged position at which the pawl is engaged with the latch bolt to hold the latch bolt in the closed position and a disengaged position at which the pawl is disengaged from the latch bolt, thereby allowing the latch bolt to move to the open position, wherein the pawl is rotatably mounted to the latch assembly via a pawl pivot pin secured to the chassis, wherein the pawl rotates about a pawl axis of the pivot pin, wherein the pawl pivot pin is movably received in a pawl pin orifice of the pawl, the pawl pin orifice including an arcuate portion defined by a radius extending from the pawl axis and wherein another arcuate portion extends from the arcuate portion and a portion of the another arcuate portion is defined by another radius extending from the pawl axis, the another radius being greater than the radius of the arcuate portion of the pawl pin orifice, and wherein an area of the pawl pin orifice is greater than an area of a circle defined by the radius of the arcuate portion of the pawl pin orifice, wherein friction between the pawl and the pawl pivot pin is reduced as the pawl pivot pin primarily contacts the arcuate portion of the pawl pin orifice.

10. The latch assembly according to claim 9 wherein the pawl pin is an eccentric rotatably mounted to the chassis about an eccentric axis remote from the pawl axis, wherein, when the pawl moves from the engaged position to the disengaged position, the eccentric rotates in one of a clockwise direction and a counter-clockwise direction about the eccentric axis, and wherein, with the pawl in the engaged position, a force applied to the pawl by the latch bolt creates a turning moment on the eccentric about the eccentric axis in the one of a clockwise direction and a counter-clockwise direction, and wherein the latch assembly further comprises a rotation prevention feature for movement between a blocking position and an unblocking position wherein the eccentric is prevented from rotating in the one of a clockwise direction and a counter-clockwise direction when the rotation prevention feature is in the blocking position.

* * * * *